US011846116B2

(12) United States Patent
Ager et al.

(10) Patent No.: US 11,846,116 B2
(45) **Date of Patent: *Dec. 19, 2023**

(54) THEATER HAVING A MODULAR AUDITORIUM AND METHOD FOR ASSEMBLING A THEATER

(71) Applicant: TAIT TOWERS MANUFACTURING, LLC, Lititz, PA (US)

(72) Inventors: Mark Ager, London (GB); Ewart Richardson, London (GB)

(73) Assignee: Tait Towers Manufacturing, LLC, Lititz, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/940,463

(22) Filed: Sep. 8, 2022

(65) Prior Publication Data

US 2023/0003041 A1 Jan. 5, 2023

Related U.S. Application Data

(63) Continuation of application No. 17/212,587, filed on Mar. 25, 2021, now Pat. No. 11,466,468, which is a (Continued)

(51) Int. Cl.
*E04H 3/12* (2006.01)
*A47C 1/12* (2006.01)
(Continued)

(52) U.S. Cl.
CPC ..... *E04H 3/126* (2013.01); *A47C 1/12* (2013.01); *E04H 3/12* (2013.01); *E04H 3/30* (2013.01);
(Continued)

(58) Field of Classification Search
CPC .. E04H 3/14; E04H 3/22; E04H 3/123; E04H 3/126; E04H 3/142; E04H 3/145;
(Continued)

(56) References Cited

U.S. PATENT DOCUMENTS 3,258,146 A 6/1966 Hamilton
3,884,524 A 5/1975 Eberle
(Continued)

FOREIGN PATENT DOCUMENTS

CA 2793598 A1 4/2014
CN 109805659 A 5/2019
(Continued)

OTHER PUBLICATIONS

PCT International Preliminary Report on Patentability, dated Apr. 8, 2020, 8 pgs.

*Primary Examiner* — Babajide A Demuren
(74) *Attorney, Agent, or Firm* — Saxton & Stump, LLC

(57) ABSTRACT

A method for assembling a theater and a theater. The method includes assembling a modular auditorium on a surface within a building structure by providing a plurality of nominal inventory portions. Each nominal inventory portions includes a prefabricated base portion, and a prefabricated tier section for assembly to the base portion. The prefabricated base portion is positioned on a ground surface of a public performance space. The prefabricated tier section is fastened to the prefabricated base portion to form a self supporting structure that does not require lateral support from a building structure other than the ground surface.

22 Claims, 36 Drawing Sheets

Related U.S. Application Data continuation of application No. 16/685,212, filed on Nov. 15, 2019, now Pat. No. 11,066,840, which is a continuation of application No. 15/723,563, filed on Oct. 3, 2017, now Pat. No. 10,513,861.

(60) Provisional application No. 62/410,088, filed on Oct. 19, 2016.

(51) Int. Cl.
*E04H 3/30* (2006.01)
*E04H 3/14* (2006.01)

(52) U.S. Cl.
CPC .. *E04H 2003/145* (2013.01); *E04H 2003/147* (2013.01)

(58) Field of Classification Search
CPC .... E04H 3/147; A63G 2200/00; A63G 27/02; A63G 9/08
See application file for complete search history.

(56) References Cited

U.S. PATENT DOCUMENTS

| | | | | |
|---|---|---|---|---|
| 4,367,612 | A | 1/1983 | Sutter | |
| 4,669,949 | A | 6/1987 | Sutton | |
| 5,188,566 | A | 2/1993 | Bohme | |
| 5,277,001 | A * | 1/1994 | Bryant | E04H 3/123 52/9 |
| 5,660,000 | A | 8/1997 | MacIntyre | |
| 5,809,906 | A | 9/1998 | Janek | |
| 6,138,427 | A | 10/2000 | Houghton | |
| 8,926,440 | B2 | 1/2015 | Jacobi | |
| 9,163,420 | B2 | 10/2015 | Behague et al. | |
| 9,809,987 | B2 * | 11/2017 | Koch | A47C 1/121 |
| 9,828,224 | B1 | 11/2017 | Hamilton | |
| 10,046,884 | B1 | 8/2018 | Erschen et al. | |
| 2002/0078633 | A1 | 6/2002 | Jines et al. | |
| 2003/0046875 | A1 | 3/2003 | Ortner | |
| 2006/0086881 | A1 | 4/2006 | Miller | |
| 2008/0190038 | A1 | 8/2008 | Jacobs et al. | |
| 2013/0123030 | A1 | 5/2013 | Jacobi | |
| 2015/0273348 | A1 | 10/2015 | Job et al. | |
| 2016/0325201 | A1 | 11/2016 | Li et al. | |
| 2017/0226761 | A1 | 8/2017 | Phillips | |
| 2017/0234021 | A1 | 8/2017 | de Lespinois et al. | |
| 2018/0130565 | A1 | 5/2018 | Lehnert et al. | |
| 2020/0386038 | A1 | 12/2020 | Salentine et al. | |

FOREIGN PATENT DOCUMENTS

| | | | |
|---|---|---|---|
| DE | 8914828 | U1 | 4/1991 |
| DE | 19818538 | A | 11/1999 |
| FR | 3002778 | A1 | 9/2014 |
| WO | 9113661 | A1 | 9/1991 |
| WO | 2007057171 | A2 | 5/2007 |

* cited by examiner

THEATER HAVING A MODULAR AUDITORIUM AND METHOD FOR ASSEMBLING A THEATER

CROSS-REFERENCE TO RELATED APPLICATIONS

The present application is a continuation application, which claims priority and benefit of Non-Provisional patent application Ser. No. 17/212,587, filed Mar. 25, 2021, currently; Non-Provisional patent application Ser. No. 16/685,212, filed Nov. 15, 2019, now U.S. Pat. No. 11,066,840; Non-Provisional patent application Ser. No. 15/723,563, filed Oct. 3, 2017, now U.S. Pat. No. 10,513,861; and U.S. Provisional Patent Application No. 62/410,088, filed Oct. 19, 2016, each of which are incorporated by reference in their entirety.

FIELD OF THE INVENTION

The present invention is directed to auditoriums, and in particular, to prefabricated auditoriums and methods for manufacturing and transporting prefabricated auditoriums.

BACKGROUND OF THE INVENTION

It is sometimes desirable to reconfigure building structures. For example, it may be desirable to reconfigure a building structure so as to place the structure in a condition in which it is more suitable for operation as a public performance space capable of comfortably accommodating patrons who attend live events, recorded media presentations, or combinations thereof. Sometimes the reconfiguration of the structure may entail relatively extensive, and perhaps relatively costly, modifications to the structure to ensure that the re-configured structure meets an aesthetics standard and meets audience satisfaction standards such as, for example, satisfactory sight lines for each patron to view a performance and suitable fixtures providing adequate comfort at the viewing locations (i.e., seats or other customary audience gallery accommodations).

It would be desirable to provide apparatus and previously configured modules that facilitate the reconfiguration of building structures for use as public performance spaces and to provide methods of manufacturing such previously configured modules and methods for transporting and erecting such previously configured modules at the locations of the public performance spaces. Additionally, it would be desirable to provide apparatus and previously configured modules that facilitate the original construction of building structures operable as public performance spaces and to provide methods of manufacturing such previously configured modules and methods for transporting and erecting such previously configured modules at the locations of the public performance spaces.

SUMMARY OF THE INVENTION

An embodiment according to the present disclosure is directed to a method for assembling a modular auditorium. The method includes providing a plurality of nominal inventory portions. Each nominal inventory portions includes a prefabricated base portion, and a prefabricated tier section for assembly to the base portion. The prefabricated base portion is positioned on a ground surface of a public performance space. The prefabricated tier section is fastened to the prefabricated base portion to form a self supporting modular auditorium structure that does not require lateral support from a building structure other than the ground surface.

Another embodiment is directed to a modular auditorium. The modular auditorium includes a plurality of nominal inventory portions for placement on a ground surface of a public performance space. Each nominal inventory portion includes a prefabricated base portion and a prefabricated tier section for assembly to the prefabricated base portion. The modular auditorium, when assembled, is self supporting and does not require lateral support from a building structure other than the ground surface.

Another embodiment is directed to a lifting fixture securable to a lifting machine adapted for lifting/manipulating corresponding tier sections for assembly/disassembly of a modular auditorium including a plurality of tubes connected to a first fixture portion and a second fixture portion, the plurality of tubes adapted to be selectively secured to the lifting machine, the first fixture portion and the second fixture portion including a plurality of lifting interfaces adapted to interface with corresponding lifting interfaces of the corresponding tier sections.

Another embodiment is directed to a lifting fixture securable to a lifting machine adapted for lifting/manipulating corresponding tier sections for assembly/disassembly of a modular auditorium including a plurality of tubes parallel to one another and connected to a first fixture portion and a second fixture portion, the plurality of tubes adapted to be selectively secured to the lifting machine, the first fixture portion and the second fixture portion including a plurality of lifting interfaces adapted to interface with corresponding lifting interfaces of the corresponding tier sections. The lifting fixture further includes the second fixture portion including a plurality of beams connected to the plurality of tubes, the plurality of beams and the plurality of tubes defining an L-shape.

Another embodiment is directed to a lifting fixture securable to a forklift machine adapted for lifting/manipulating corresponding tier sections for assembly/disassembly of a modular auditorium including a plurality of tubes parallel to one another and connected to a first fixture portion and a second fixture portion, the plurality of tubes adapted to be selectively secured to the lifting machine, the first fixture portion and the second fixture portion including a plurality of lifting interfaces adapted to interface with corresponding lifting interfaces of the corresponding tier sections. The lifting fixture further includes the second fixture portion including a plurality of beams connected to the plurality of tubes, the plurality of beams and the plurality of tubes defining an L-shape. The lifting fixture further includes each tube of the plurality of tubes adapted to receive a corresponding fork of the forklift machine, each tube of the plurality of tubes including a fork tine retention feature. The lifting fixture further includes each lifting interface of the lifting interfaces of the corresponding tier sections correspond to a chair interface of the corresponding tier section, the second fixture portion being selectively separable from the plurality of tubes. The lifting fixture further includes the first fixture portion including a first cross member having an open end, a plurality of stiffeners positioned in the open end of the first cross member between each lifting interface of the plurality of lifting interfaces. The lifting fixture further includes the second fixture portion including a second cross member having an open end, a plurality of stiffeners positioned in the open end of the second cross member between each lifting interface of the plurality of lifting interfaces.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

The present invention provides a modular auditorium and a method for manufacturing a modular auditorium in its entirety in the form of a previously configured module, a type of which is herein denominated as a prefabricated module, or a modular auditorium comprised at least in part of a prefabricated module. As used herein, the term "modular auditorium" is intended to refer to a particular configuration of an audience host combination that is specifically configured to be deployable as an element of a theater having a performance space. The following description provided in connection with FIGS. 1-2, 2A, 3-7, 7A, 8-11, 11A, 12, 12A, 13, 13A, 14-18, 18A, 19-26, 26A, 27-30, 30A, 31, 32, 32A, 33-35, 35A, 36-45 is directed to a modular auditorium.

Figure 1:
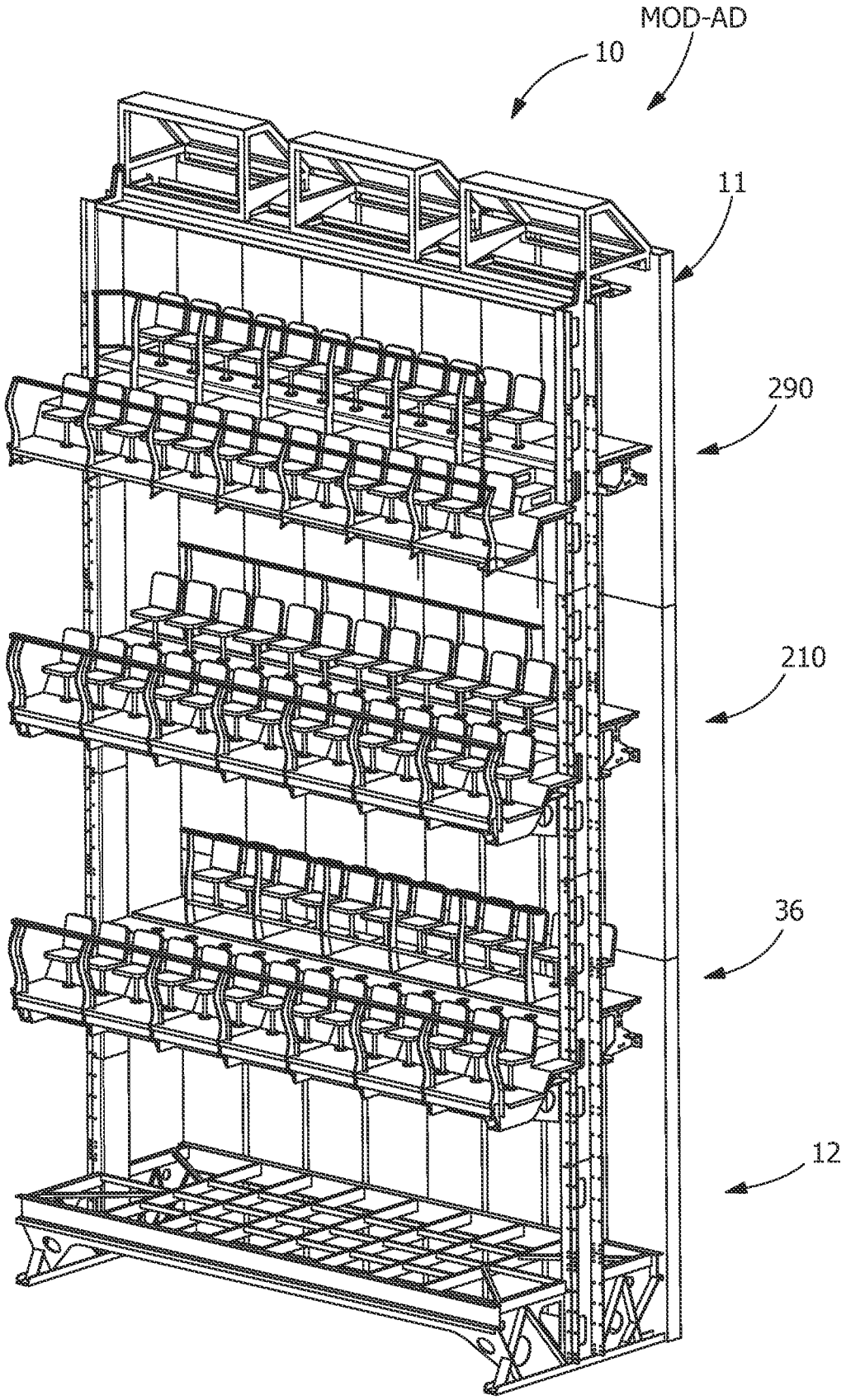
FIG. 1 is an upper perspective view of an exemplary modular auditorium.

As seen in FIG. 1, which is an upper perspective view of an exemplary modular auditorium, a modular auditorium hereinafter designated as the modular auditorium MOD-AD may be configured to facilitate the reconfiguration of building structures for use as public performance spaces or may be configured to facilitate the original construction of building structures operable as public performance spaces. The modular auditorium MOD-AD is constructed such that only the surface for supporting the weight of the modular auditorium MOD-AD (i.e., a prepared ground surface or a man-made surface supported above a ground surface) is required. In other words, the modular auditorium MOD-AD is self-supporting and does not require lateral support from another building structure. As a result, the modular auditorium MOD-AD can be assembled inside of a building structure, such as an existing enclosed building structure (i.e., having a roof) for protecting the modular auditorium MOD-AD from the weather. The modular auditorium MOD-AD includes one or more arbitrarily designated nominal inventory portions having one or more tier sections supported by a base portion. Each nominal inventory portion includes a tier floor having corresponding floor portions that are cantilevered from a longitudinal beam or torque tube. The floor portions are made up of modules composed of ribs interconnected to panels. The panels include openings configured to permit at least one of the following: to receive illumination sources, to provide ventilation therethrough and to receive a sound generating device. Each nominal inventory portion also includes seats and handrails. A back wall is constructed with passageways for providing electrical wiring, conveying ventilation air, as well as providing egress/ingress for spectators to each tier of the nominal inventory portions. Each nominal inventory portion is configured to be transportable and positioned for assembly with other nominal inventory portions, such as by a forklift machine. As a result, assembly of the modular auditorium MOD-AD is greatly simplified and can be achieved quickly.

For purposes herein, the term "prefabricated" is intended to mean that a nominal inventory portion as disclosed in further detail below is comprised of base portions and tier sections, each of which is structurally complete to a significant extent and, consequently, merely requiring the interconnection of the base portions and tier sections, such as by mechanical fasteners or welding, to essentially complete the structural assembly of the nominal inventory portion at the permanent site. It is to be understood that the installation or interconnection of components for ventilation or illumination purposes, the installation or interconnection of any electrical wiring or related components or ornamental features, and the installation of seating for each tier section can occur subsequent to the interconnection of the base portions and tier sections, and that these type of components are typically not considered as providing additional structural support. For purposes herein, the term "projecting" is intended to mean an orientation of one piece or component to another piece or component and includes both the situation in which one piece or component projects relative to, and is completely supported by, the other piece or component and the situation in which neither the one piece or component or the other piece or component completely support the other respective piece or component.

Figure 2:
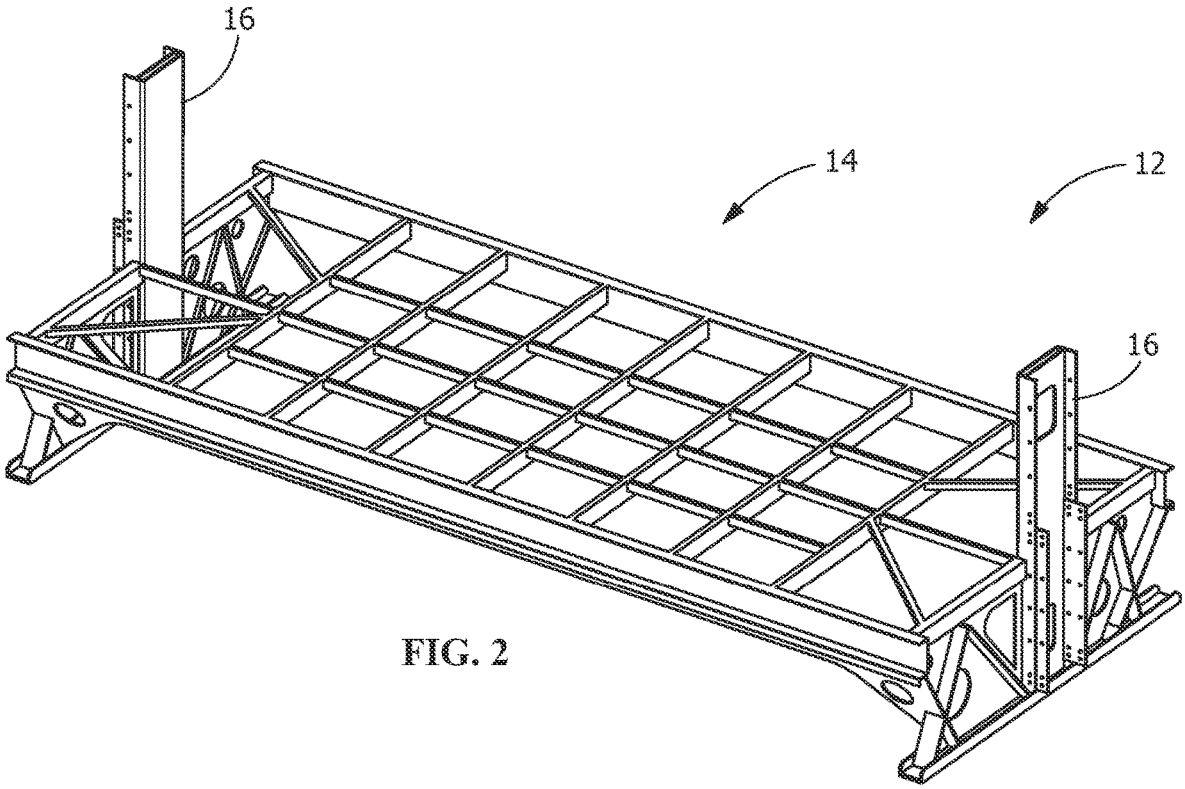
FIG. 2 is an upper perspective view of an exemplary base portion.
Figure 3:
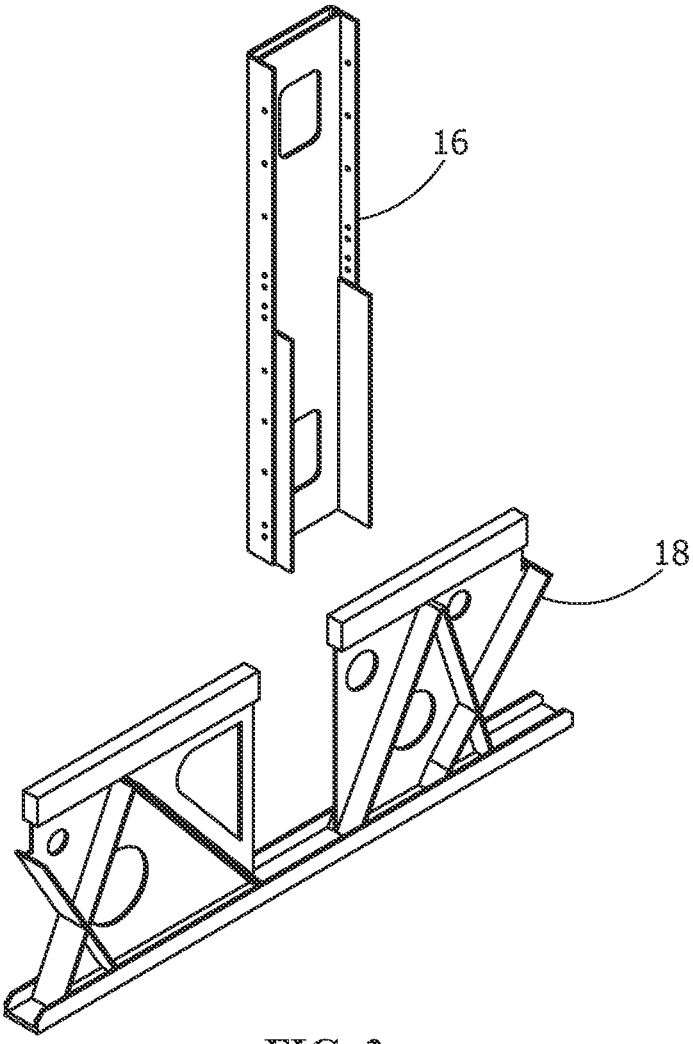
FIG. 3 is an exploded view of an exemplary base rig.
Figure 4:
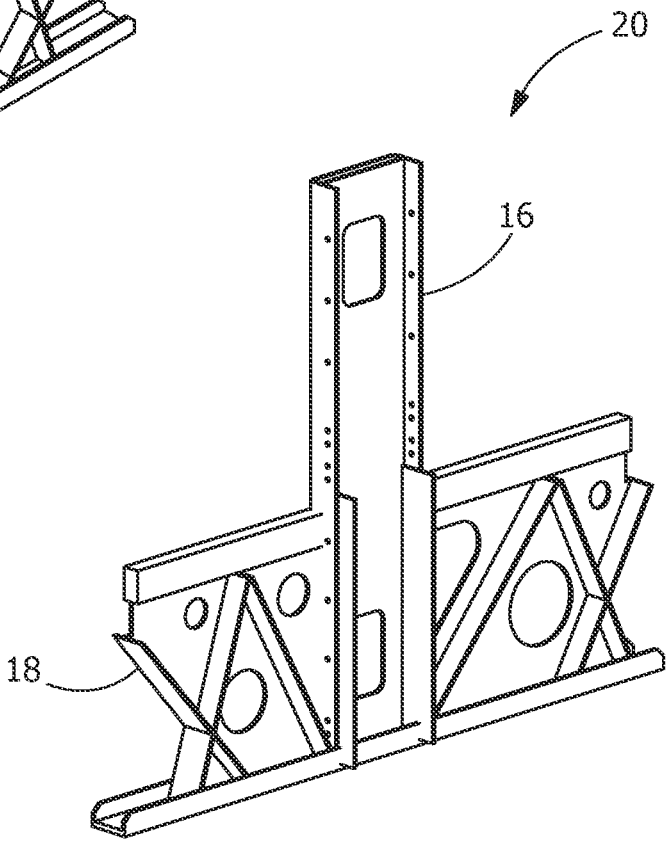
FIG. 4 is an upper perspective view of the assembled base rig of FIG. 3.
Figure 5:
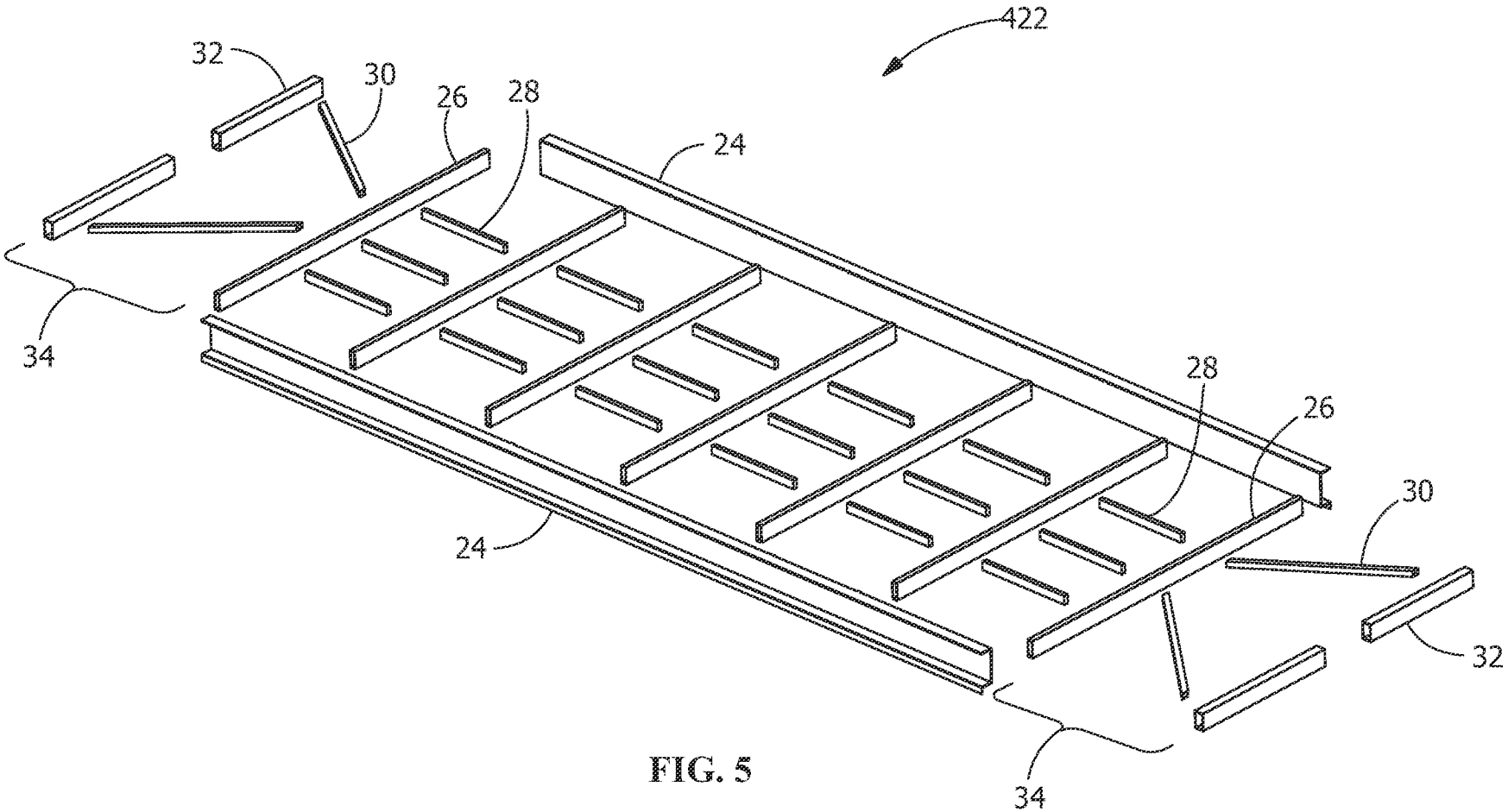
FIG. 5 is an exploded view of an exemplary frame portion.
Figure 6:
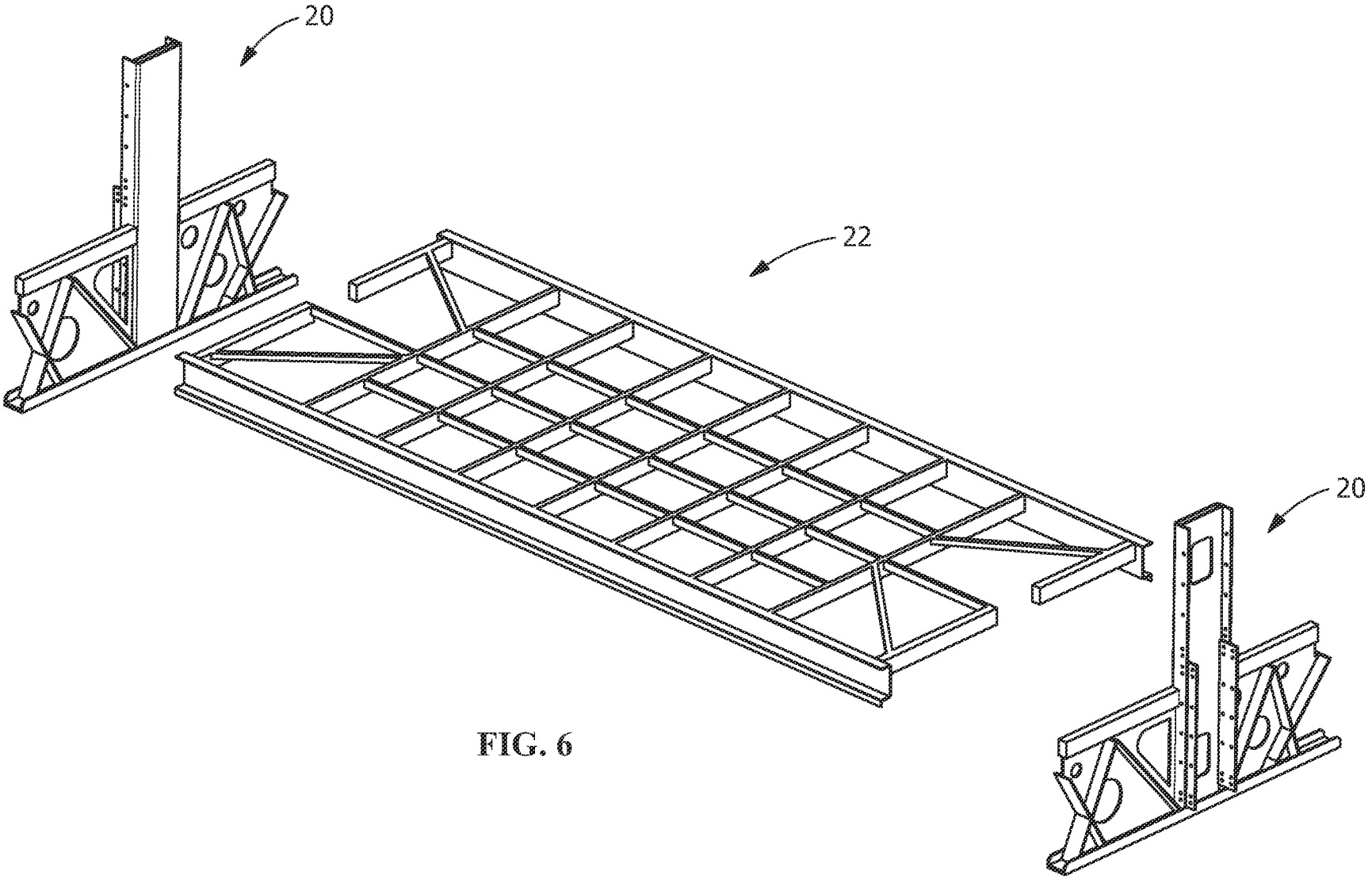
FIG. 6 is an exploded view of the assembled frame portion of FIG. 5 and associated assembled base rigs of FIG. 4.

FIG. 1 shows the nominal inventory portion 10 having a base portion 12 and three tier sections 36, 210, 290. In one embodiment, the nominal inventory portion can have a different number of tier sections than three. As shown in FIGS. 2-6, base portion 12 includes a frame 14 and a pair of vertical beams 16. As shown, frame 14 includes a frame portion 18 and a frame portion 22 (FIG. 6). As shown in FIGS. 3-4, each vertical beam 16 is secured to a corresponding frame portion 18 such as by welding, mechanical fasteners or other suitable technique. Securing frame portion 18 to vertical beams 16 results in a base rig 20. FIG. 5 shows an exploded view of an unassembled frame portion 422, with FIG. 6 showing an assembled frame portion 22. Frame portion 422 includes opposed longitudinal beams 24 that are secured to a plurality of frame members 26 extending generally perpendicular to longitudinal beams 24. Longitudinal frame members 28 extend generally perpendicular to and are secured to adjacent frame members 26. As shown in FIGS. 5-6, a pair of opposed frame members 30 extend outwardly from the outermost positioned frame members 26. Frame members 32, which extend generally parallel to frame members 26, are secured to corresponding frame members 30. Frame members 30, 32 form opposed end sections 34. FIG. 6 shows an exploded view of assembled frame portion 22 positioned between opposed base subassemblies 20. Assembly of frame portion 22 and base subassemblies 20 forms frame 14 (FIG. 2).

Figure 2A:
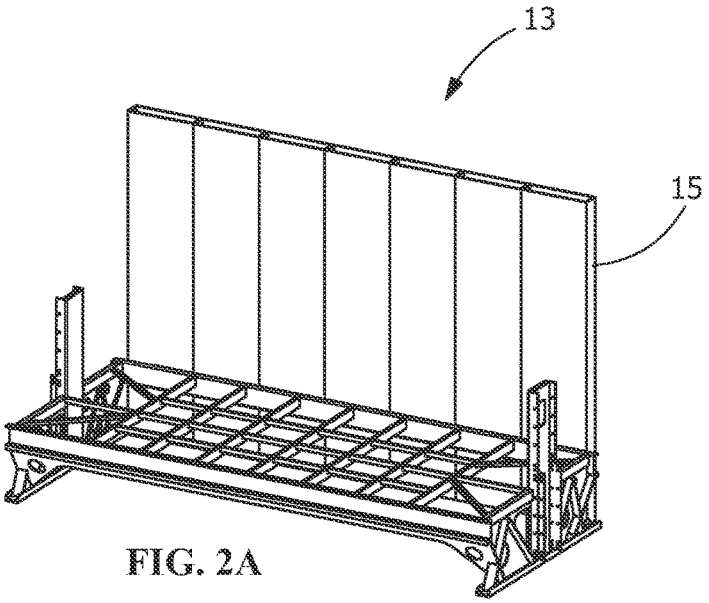
FIG. 2A is an upper perspective view of an exemplary base portion.

In one embodiment, as shown in FIG. 2A, base portion 13 essentially includes the combination of base portion 12 (FIG. 2) and a back wall portion 15 of the back wall 11 (FIG. 1). In one embodiment, a back wall portion 39 of the back wall is combined with tier section 37 (FIG. 7A), not base portion 12. In one embodiment, a back wall portion of the back wall is combined with each of base portion 13 and tier section 211.

FIGS. 7-10 show a tier section 36. Tier section 36 includes a longitudinal beam 68 having opposed ends that are secured to vertical beams 50. Tier section 36 further includes a tier floor 38 having a "loge" floor portion 40 forming a forward section and an opposed floor portion 42 forming a backset section. Floor portions 40, 42 are oriented in front-to-back staggered relation to one another and are secured to opposed regions, such as opposed vertical walls of longitudinal beam 68 (rectangular cross-section shown in FIG. 15) such that floor portions 40, 42 are cantilevered from longitudinal beam 68.

For purposes herein, the term "loge" is intended to mean the region or forward extent of a tier section facing toward a performance space. For example, "loge" floor portion 40 of tier section 36 faces toward a performance space, with opposed floor portion 42 facing away from the performance space.

Figure 7:
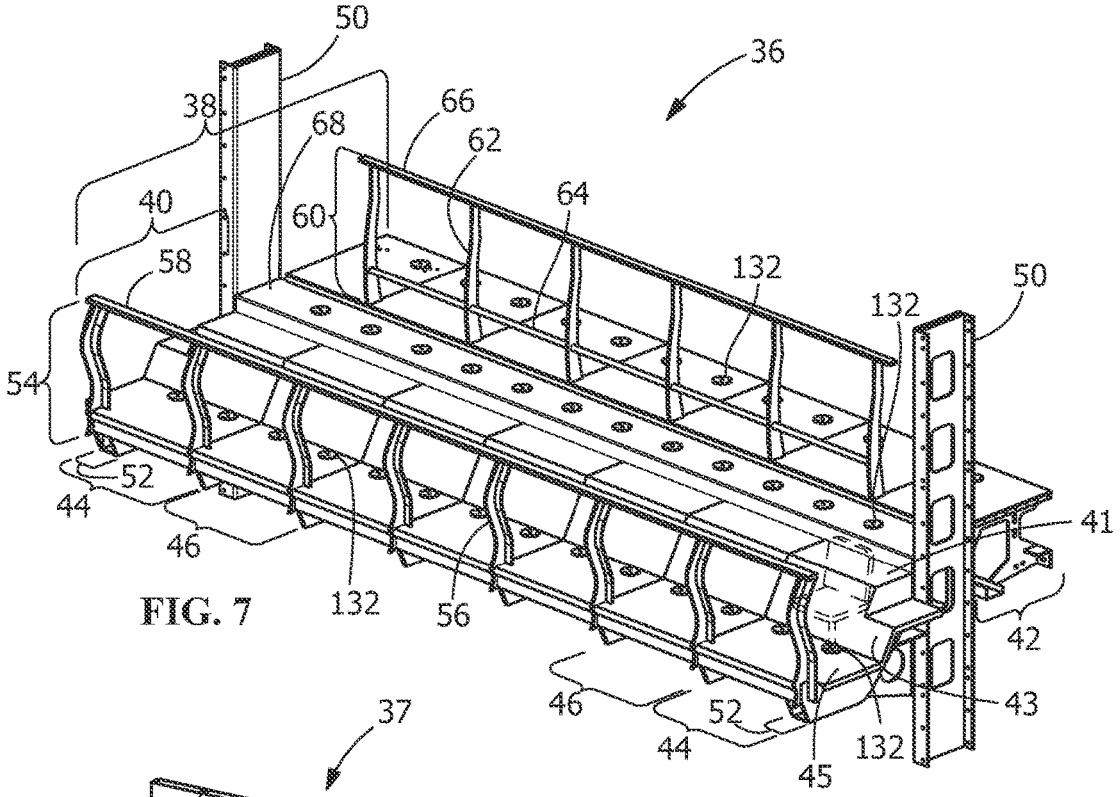
FIG. 7 is an upper perspective view of an exemplary tier section.
Figure 7A:
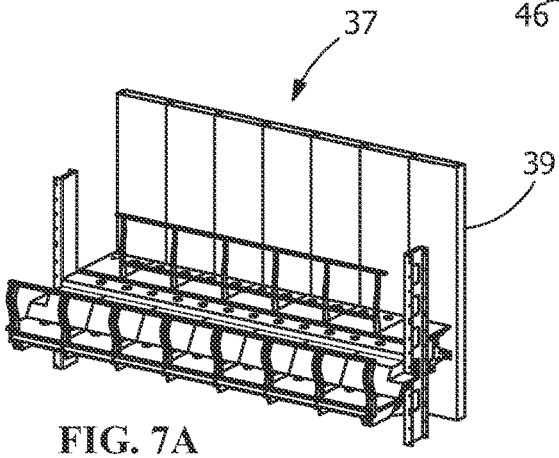
FIG. 7A is an upper perspective view of an exemplary tier section.
Figure 8:
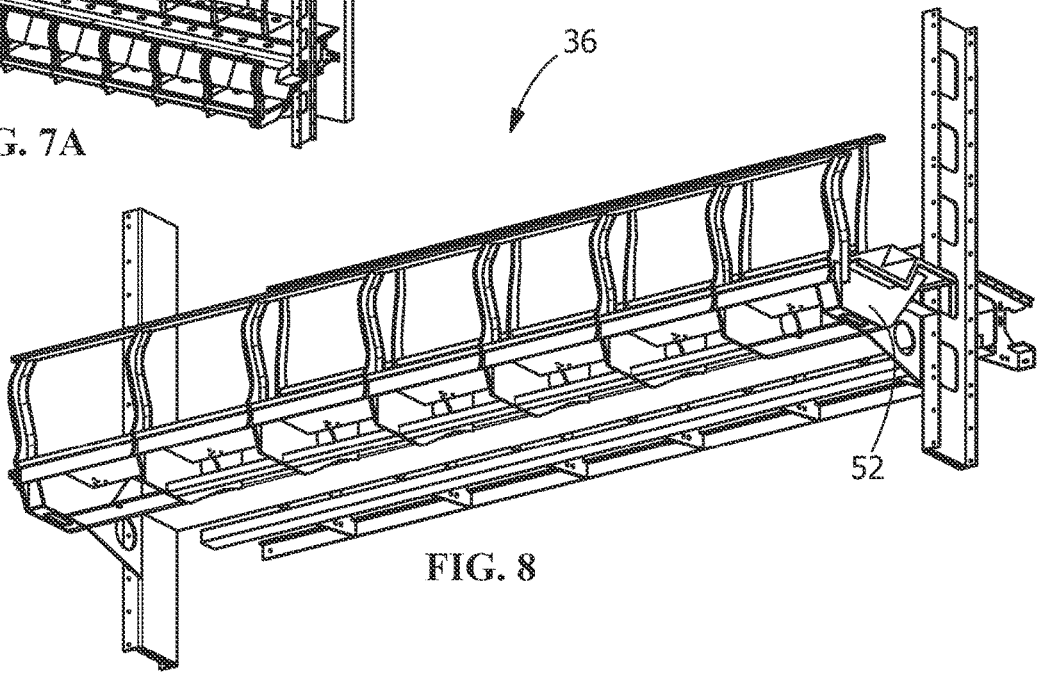
FIG. 8 is a reverse lower perspective view of the tier section of FIG. 7.
Figure 9:
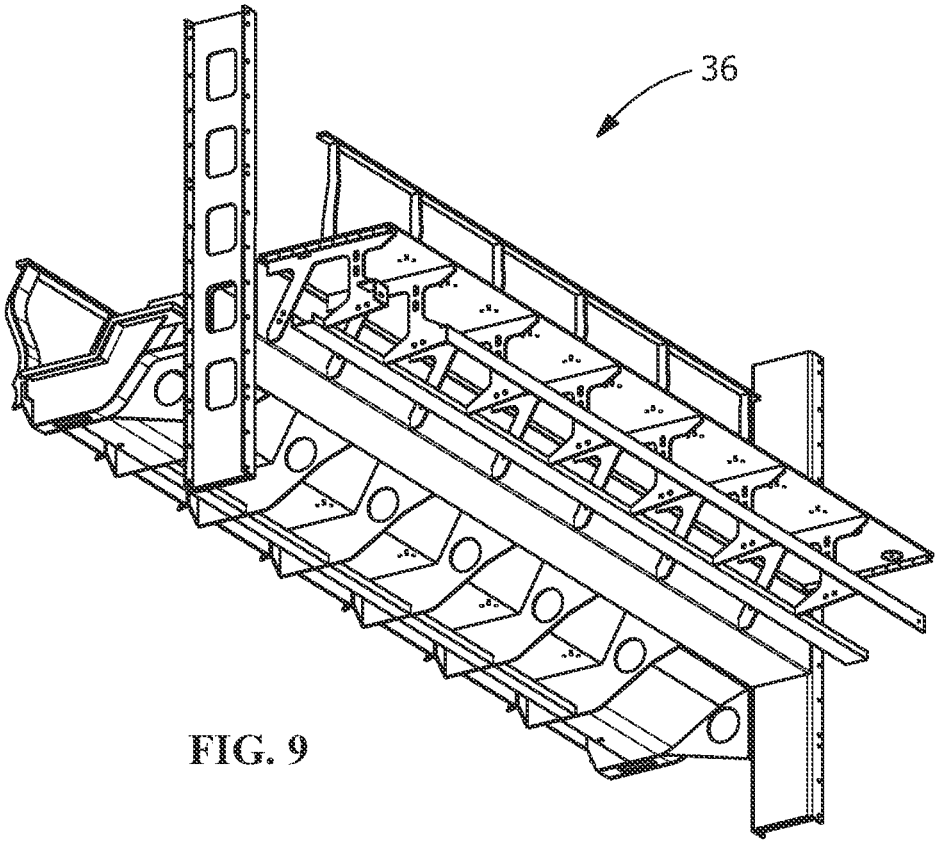
FIG. 9 is a lower perspective view of the tier section of FIG. 7.
Figure 10:
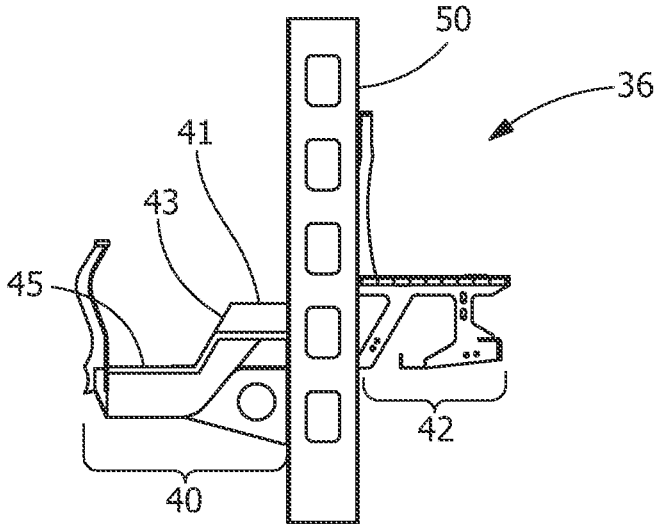
FIG. 10 is a side elevation view of the tier section of FIG. 7.

As further shown in FIGS. 7 and 10, floor portion 40 includes horizontal surfaces 41, 45 bridged by an angled surface 43. Horizontal surface 41 corresponds to panels 86 of outer modules 44 (FIG. 11) and to panels 158 of inner modules 46 (FIG. 11A). Horizontal surface 45 corresponds to panels 90 of outer modules 44 (FIG. 11) and to panels 162 of inner modules 46 (FIG. 11A). Angled surface 43 corresponds to panels 88 of outer modules 44 (FIG. 11) and to panels 160 of inner modules 46 (FIG. 11A). As further shown in FIG. 10, surfaces 41, 43, 45 trace a crooked line.

Horizontal surface 41 is positioned vertically above horizontal surface 45. As a result of this arrangement, it is apparent to one having ordinary skill in the art that the seating density, i.e., the number of seats per unit volume of tier section, 36 is increased, as a row of seats can be mounted on horizontal surface 45, and an additional row of seats can be mounted on the upper surface of longitudinal beam 68 that is adjacent to horizontal surface 41. By placing a row of seats on longitudinal beam 68, versus placing a row of seats extending from the horizontal surface of floor portion 42, floor portion 42 can accommodate increased accessibility, such as by wheelchairs.

As further shown in FIG. 7, floor portion 40 includes a guardrail 54 including rail supports 56 and a rail 58. Floor portion 42 includes a guardrail 60 including rail supports 62, support members 64 extending between adjacent rail supports 62 and a rail 66.

Figure 11:
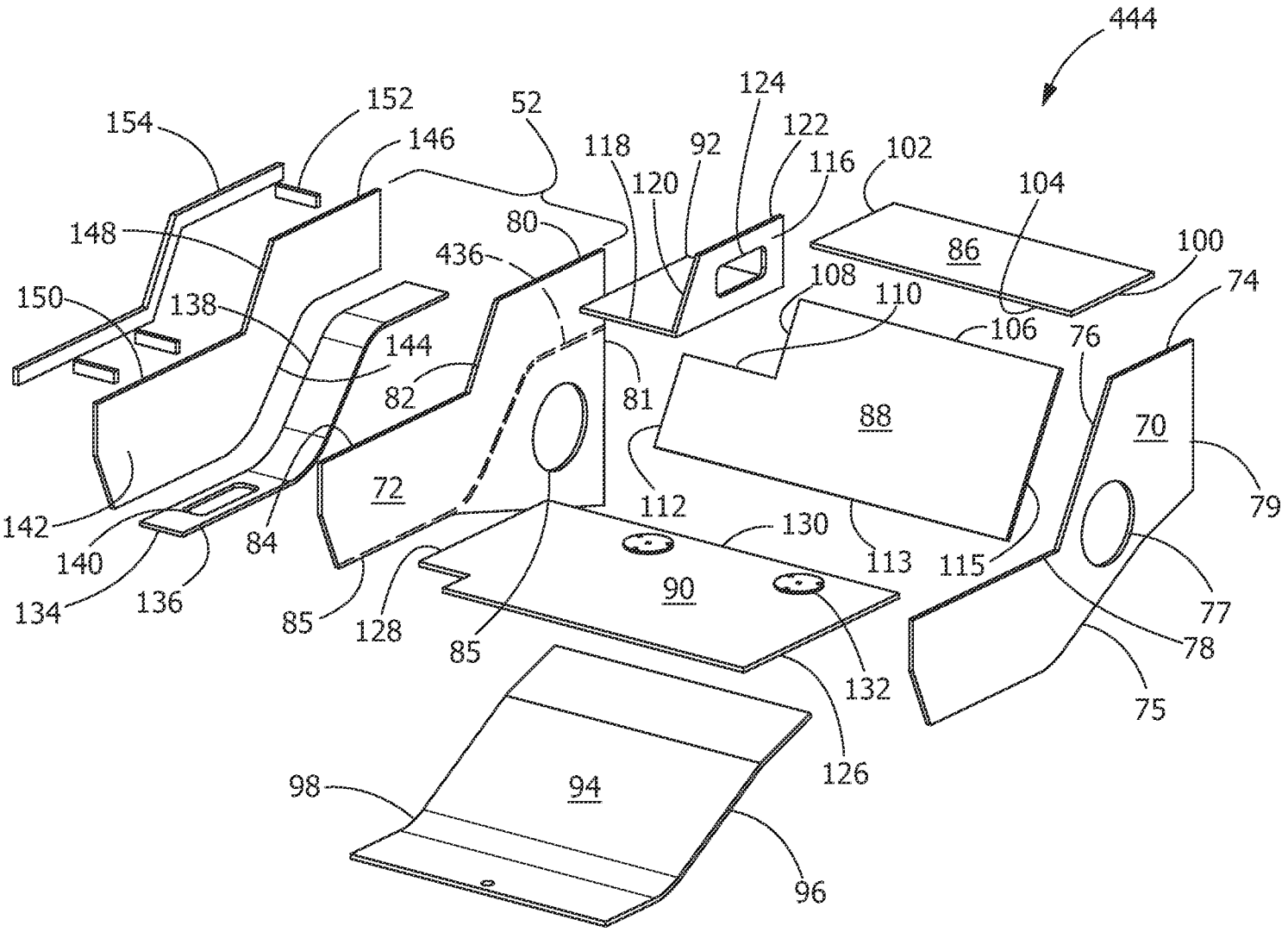
FIG. 11 is an exploded view of an exemplary tier section module.
Figure 12:
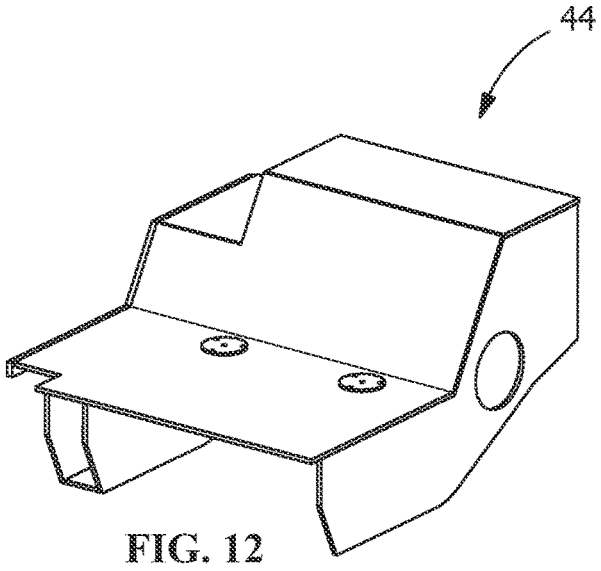
FIG. 12 is an assembled upper perspective view of the tier section module of FIG. 11.
Figure 11A:
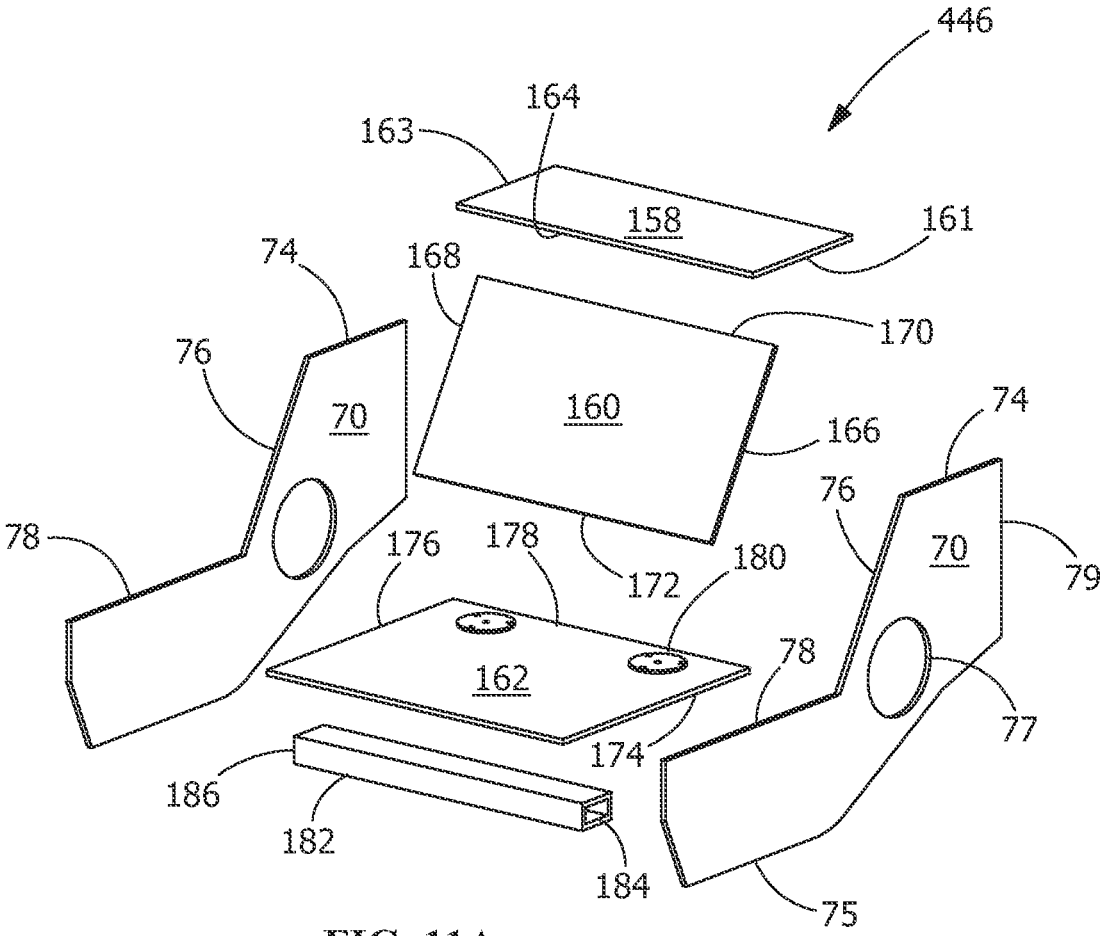
FIG. 11A is an exploded view of an exemplary tier section module.

FIG. 11 shows an exploded view of an unassembled outer module 444, and FIG. 12 shows an assembled outer module 44.

As further shown in FIG. 11, module 444 includes a rib 70 having an optional light guide hole 77 and edges 74, 75, 76, 78, 79. A rib 72 has an optional light guide hole 85 and edges 80, 81, 82, 84. Panels 86, 94, and most of each of panels 88, 92, 94 are positioned between and secured to each of ribs 70, 72. For example, as for panel 86, end 100 of panel 86 is secured to edge 74 of rib 70, edge 104 of panel 86 is secured to edge 106 of panel 88, and end 102 of panel 86 is secured to edge 122 of stair tread portion 92. As for panel 88, edge 108 is secured to edge 120 of stair tread portion 92, edge 110 of panel 88 is secured to edge 118 of stair tread portion 92. A portion of panel 88 terminating at edge 112 of panel 88 extends over and is supported by and secured to each of edge 82 of rib 72 and edge 148 of cap 142. Edge 113 of panel 88 is secured to edge 130 of panel 90, and edge 115 of panel 88 is secured to edge 76 of rib 70. As for panel 90, which includes one or more chair/lifting interfaces 132, end 126 of panel 90 is secured to edge 78 of rib 70. A portion of panel 90 terminating at end 128 extends over and is supported by and secured to each of edge 84 of rib 72 and edge 150 of cap 142. A curved panel 94 has opposed ends 96, 98, with end 96 of panel 94, 160, secured to edge 75 of rib 70, and end 98 of panel 94 secured to the facing vertical surface of rib 72. Stair tread portion 92 includes a riser 116 having an optional opening 124 (for receiving an illumination source (not shown) for providing illumination to stair tread portion 92). Stair tread portion 92 further includes a tread 114 having an edge 117 secured to an edge 80 of rib 72.

As further shown in FIG. 11, outer module 444 includes a box structure portion 52. Box structure portion 52 is formed by tread 114, panels 88, 90, rib 72, a curved panel 134, and cap 142. Curved panel 134 includes opposed ends 136, 138 and an opening 140 configured to permit at least one of the following: to receive illumination sources (not shown), to provide ventilation therethrough and to receive a sound generating device (not shown). End 136 of panel 134 is secured to rib 72 along a region 436 identified in dashed lines on rib 72. End 138 of panel 134 is secured to a curved edge 144 of cap 142, and end 136 of panel 134 is secured to region 436 (shown in dashed lines) of rib 72. Panel defines the lower portion of box structure portion 52 (FIG. 12). The upper portion of box structure portion 52 is defined by tread 114 and panels 88, 90. That is, a portion of tread 114 terminating at edge 117 extends over and is secured to edge 80 of rib 72 and edge 146 of cap 142. A portion of panel 88 terminating at edge 112 extends over and is secured to edge 82 of rib 72 and edge 148 of cap 142. A portion of panel 90 terminating at end 128 extends over and is secured to edge 84 of rib 72 and edge 150 of cap 142. A flange 154 is secured to edge 117 of tread 114, edge 112 of panel 88 and end 128 of panel 90, with stiffeners 152 positioned between and secured to each of flange 154 and cap 142.

Figure 12A:
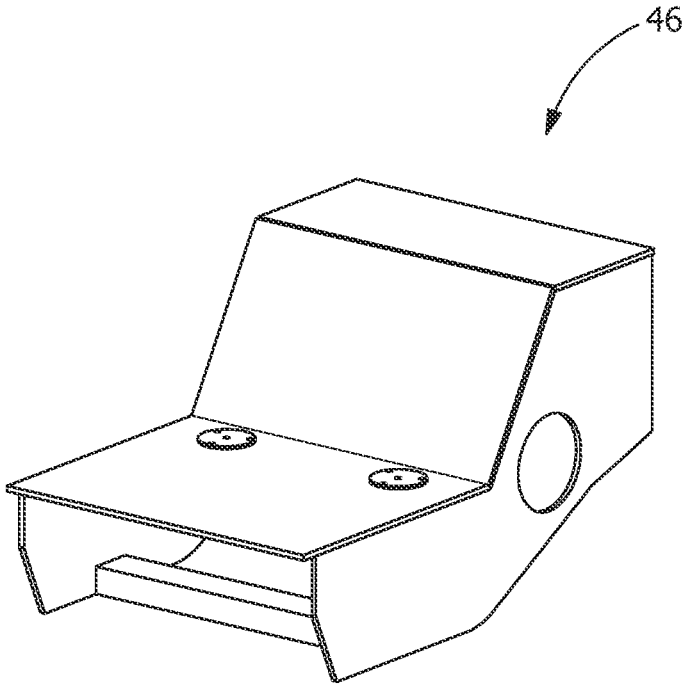
FIG. 12A is an assembled upper perspective view of the tier section module of FIG. 11A.

FIG. 11A shows an exploded view of an unassembled inner module 446, and FIG. 12A shows an assembled inner module 46.

As further shown in FIG. 11A, module 446 includes a pair of ribs 70 each having an optional light guide hole 77 and edges 74, 75, 76, 78, 79. Panels 158, 160, 162, and stiffener 182 most of each of panels 88, 92, 94 are positioned between and secured to each of ribs 70. For example, as for panel 158, end 161 of panel 158 is secured to edge 74 of rib 70, edge 164 of panel 158 is secured to edge 170 of panel 160, and end 163 of panel 158 is secured to edge 74 of rib 70. As for panel 160, end 166 is secured to edge 76 of rib 70, edge 172 panel 160 is secured to edge 178 of panel 162. End 168 of panel 160 secured to edge 76 of rib 70. As for panel 162, end 174 is secured to edge 78 of rib 70 and end 176 of panel 162 is secured to edge 78 of rib 70. As for stiffener 182 opposed ends 184, 186 are secured to corresponding vertical surfaces of ribs 70.

Figure 13:
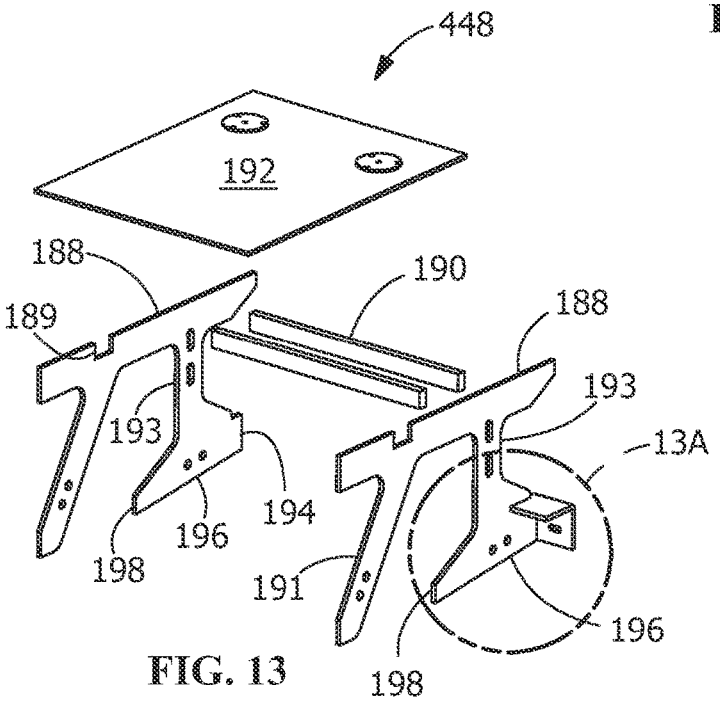
FIG. 13 is an exploded view of an exemplary tier section module.
Figure 14:
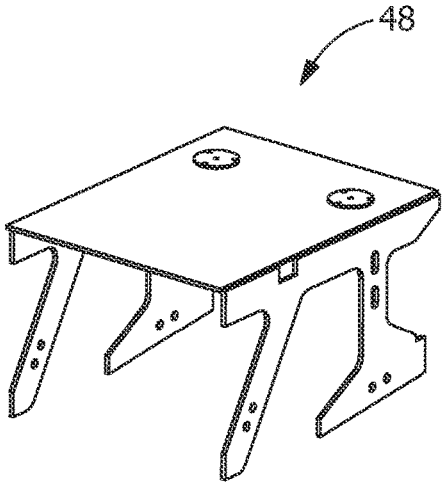
FIG. 14 is an assembled upper perspective view of the tier section module of FIG. 13.

FIG. 13 shows an exploded view of an unassembled module 448, and FIG. 14 shows an assembled outer module 48.

Figure 13A:
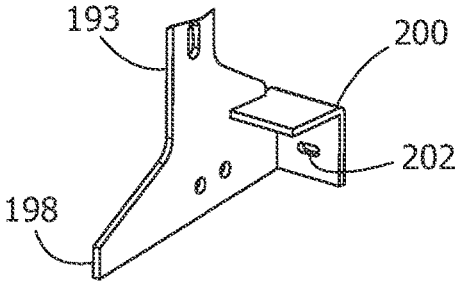
FIG. 13A is a partial, enlarged view taken from region 13A of FIG. 13, of the exemplary tier section module shown in FIG. 13.

As further shown in FIG. 13, module 448 includes opposed ribs 188 that support a panel 192. Stiffeners 190 extend between and are secured to ribs 188 and panel 192. Each of ribs 188 includes a recess 189 and outwardly extending legs 191, 193. As further shown in FIG. 13, leg 193 terminates at edges 194, 196, 198. The outermost positioned ribs 188, as shown in FIG. 13A include a variation of leg 193, in which edge 194 is replaced by an L-shaped bracket 200 having a slotted opening 202.

It is to be understood that adjacent modules 44, 46, 48 can share a common rib. In one embodiment, one or more of adjacent modules 44, 46, 48 can have their own separate ribs. By virtue of the panels and structural members secured to the ribs, and possibly the longitudinal beam 68, the modules have additional structural strength and rigidity, and can act as additional torque tubes, or torque transmitting members.

Figure 15:
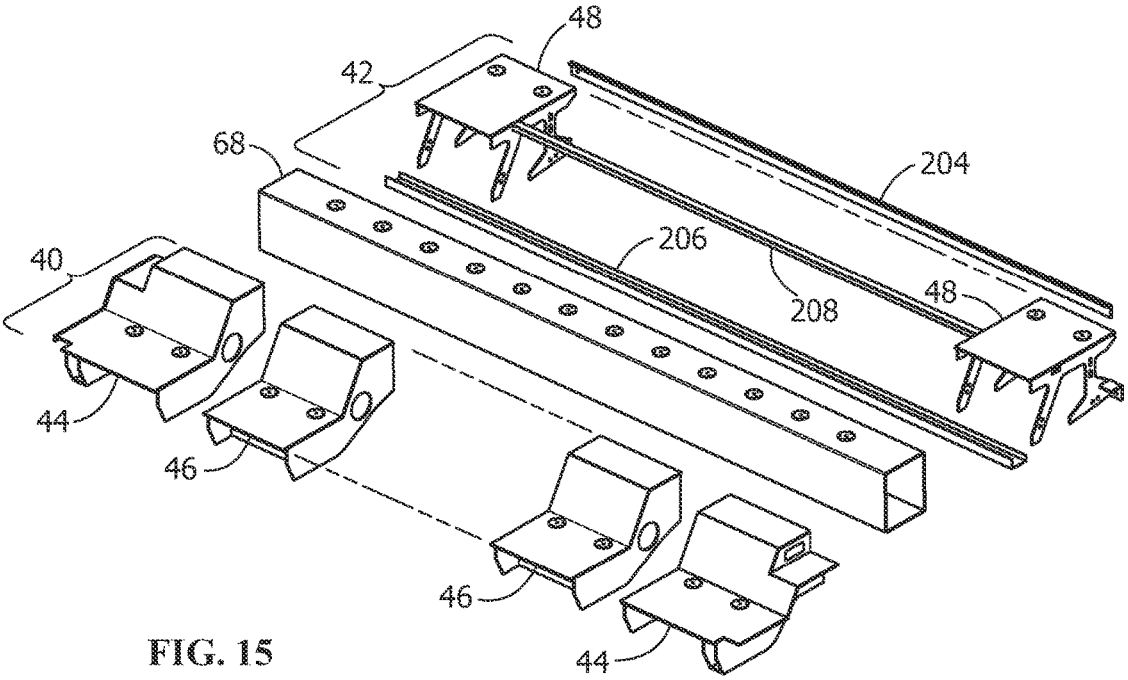
FIG. 15 is an exploded view of assembled tier section modules of FIGS. 12, 12A, 14 and an exemplary beam.
Figure 16:
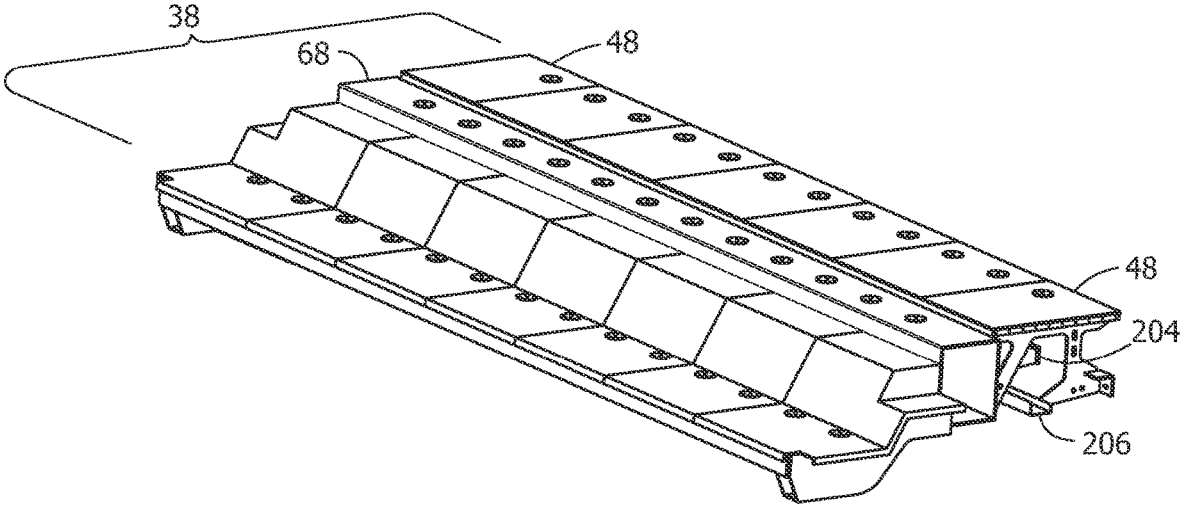
FIG. 16 is an upper perspective view of the assembled tier section modules of FIGS. 12, 12A, 14 and the exemplary beam of FIG. 15.

FIG. 15 is an exploded view of floor portions 40, 42 including assembled tier section modules 44, 46, 48 secured to opposed regions, such as opposed vertical sidewalls of longitudinal beam 68. A U-shaped beam 206 is secured to edges 198 of modules 48, providing a raceway in the form of a trough for electrical wiring and other uses. A cap 204 is secured to edges 194 of ribs 188, except for the outermost positioned ribs 188, to which a corresponding portion of back wall 39 (FIG. 7A) is secured via a slotted opening 202 (FIG. 13A) of L-shaped bracket 200 (FIG. 13A) by fasteners (not shown). Additionally, a tubular beam 208 is inserted through openings formed by recesses 189 (FIG. 13) of ribs 188 and secured to recesses 189 and panels 192 (FIG. 13) of modules 48.

Figure 17:
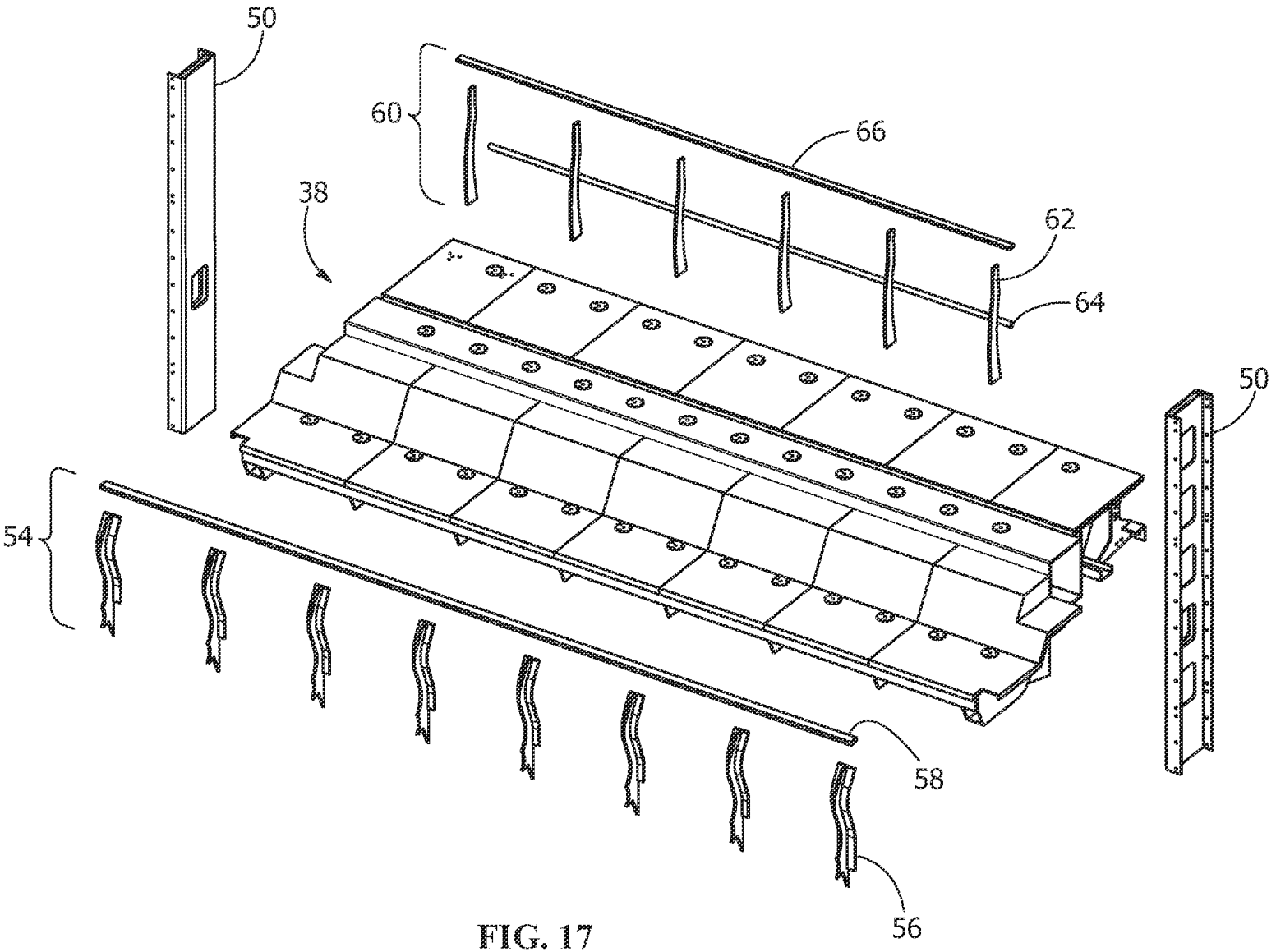
FIG. 17 is an exploded view of an exemplary assembled tier floor, exemplary guardrails, and exemplary vertical beams.

FIG. 17 is an exploded view of an assembled tier floor 38, guardrails 54, 60, and vertical beams 50. In one embodiment, at least a portion of rail support 56 extends from ribs 70, 72. That is, the rail supports can extend from corresponding ends of the ribs. Stated another way, the rail supports can be of one-piece or unitary construction with the ribs. This arrangement can be equally applicable to other tier floors of other tier sections.

FIGS. 18-21 show a tier section 210. Tier section 210 includes a longitudinal beam 224 having opposed ends that are secured to vertical beams 230. Tier section 210 further includes a tier floor 212 having a "loge" floor portion 214 and an opposed floor portion 216. Floor portions 214, 216 are secured to opposed regions, such as opposed vertical walls of longitudinal beam 224 (rectangular cross-section shown in FIG. 15 for longitudinal beam 68) such that floor portions 214, 216 are cantilevered from longitudinal beam 224. As further shown in FIG. 18, floor portion 214 includes a guardrail 226. Floor portion 216 includes a guardrail 228. Outer module 218, inner module 220, and module 222 are similar to respective modules 44, 46, 48, which discussion is not repeated herein. Box structure portion 232 is similar to box structure portion 52, which discussion is not repeated herein.

As further shown in FIGS. 18-21, the lower surfaces of modules 218, 220 are defined by panels 242, 244, 246 having respective openings 236, 238, 240. Openings 248 (FIG. 18) are also associated with the stair portion (not numbered) of module 218. Opening 234 is associated with box structure portion 232. Openings 234, 236, 238, 240, 248 are configured to permit at least one of the following: to receive illumination sources, to provide ventilation therethrough and to receive a sound generating device.

Figure 18:
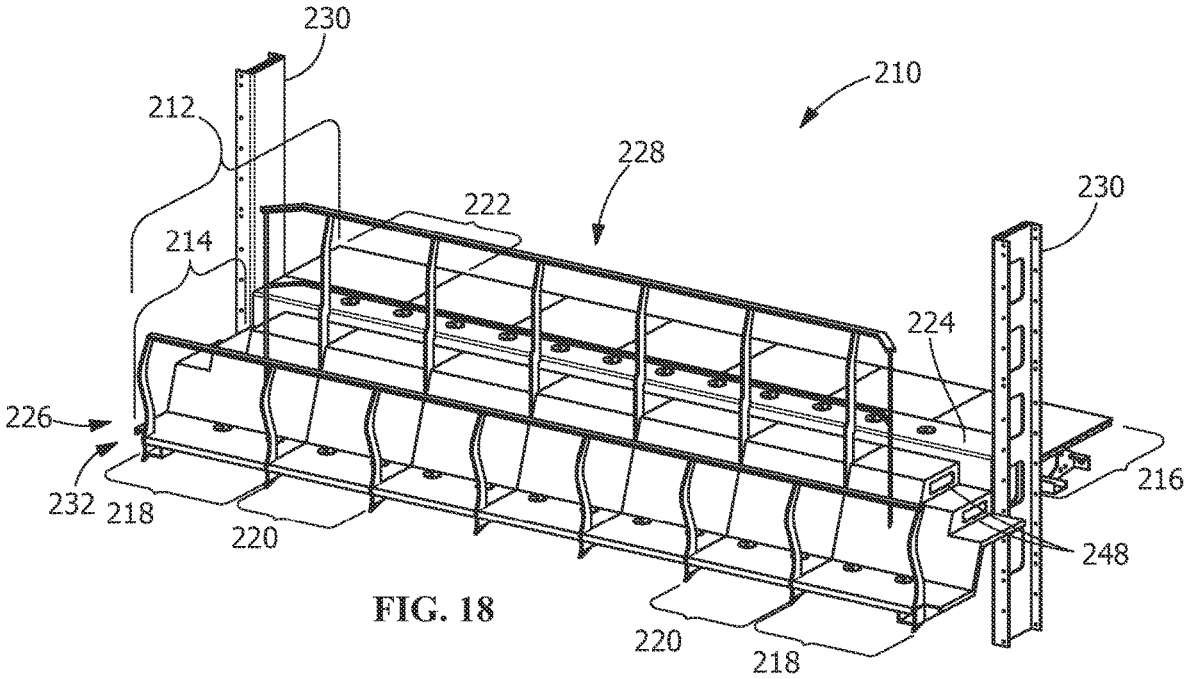
FIG. 18 is an upper perspective view of an exemplary tier section.
Figure 18A:
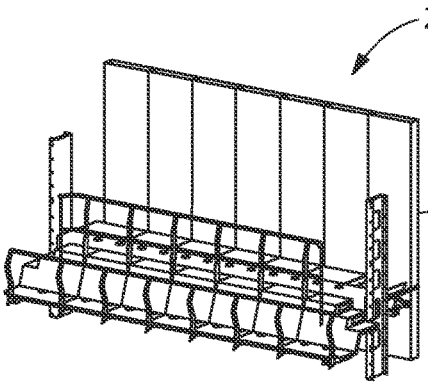
FIG. 18A is an upper perspective view of an exemplary tier section.
Figure 19:
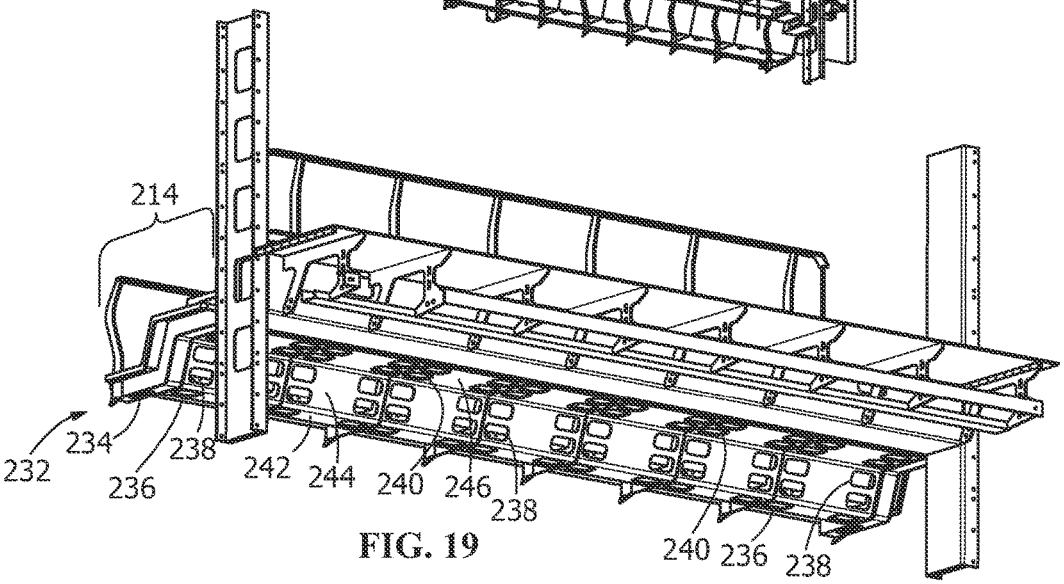
FIG. 19 is a reverse lower perspective view of the tier section of FIG. 18.
Figure 20:
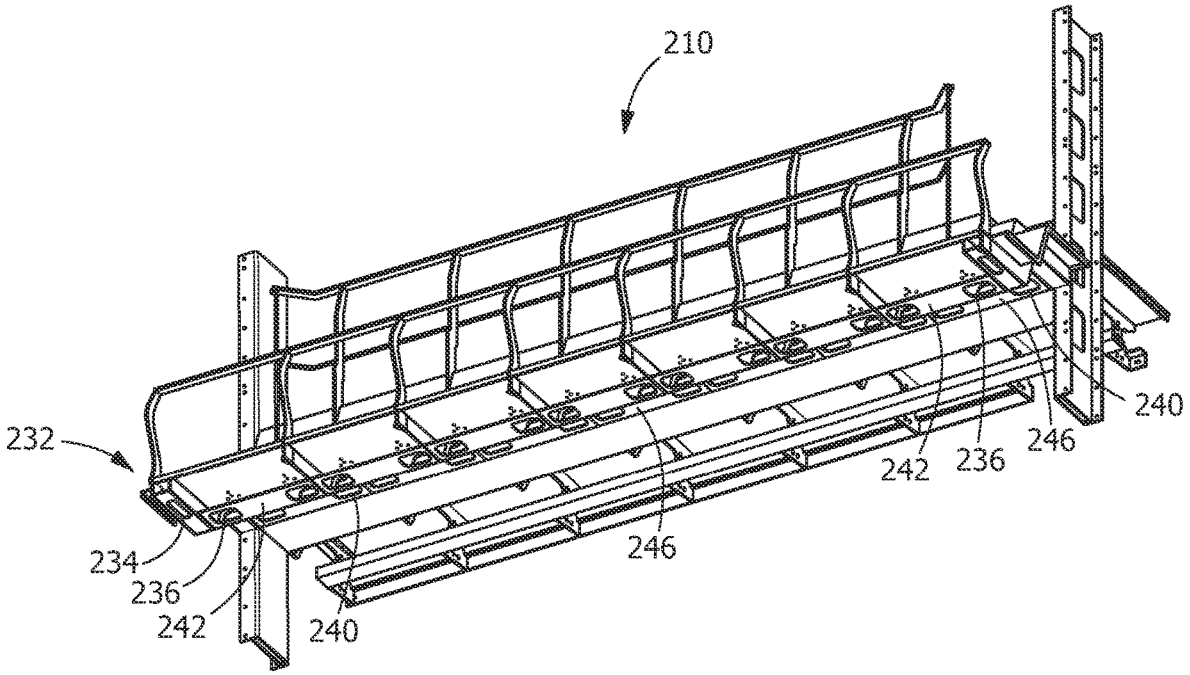
FIG. 20 is a lower perspective view of the tier section of FIG. 18.
Figure 21:
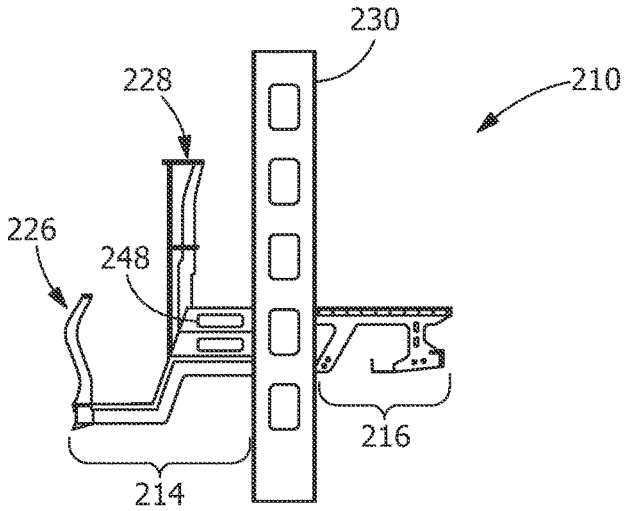
FIG. 21 is a side elevation view of the tier section of FIG. 18.
Figure 22:
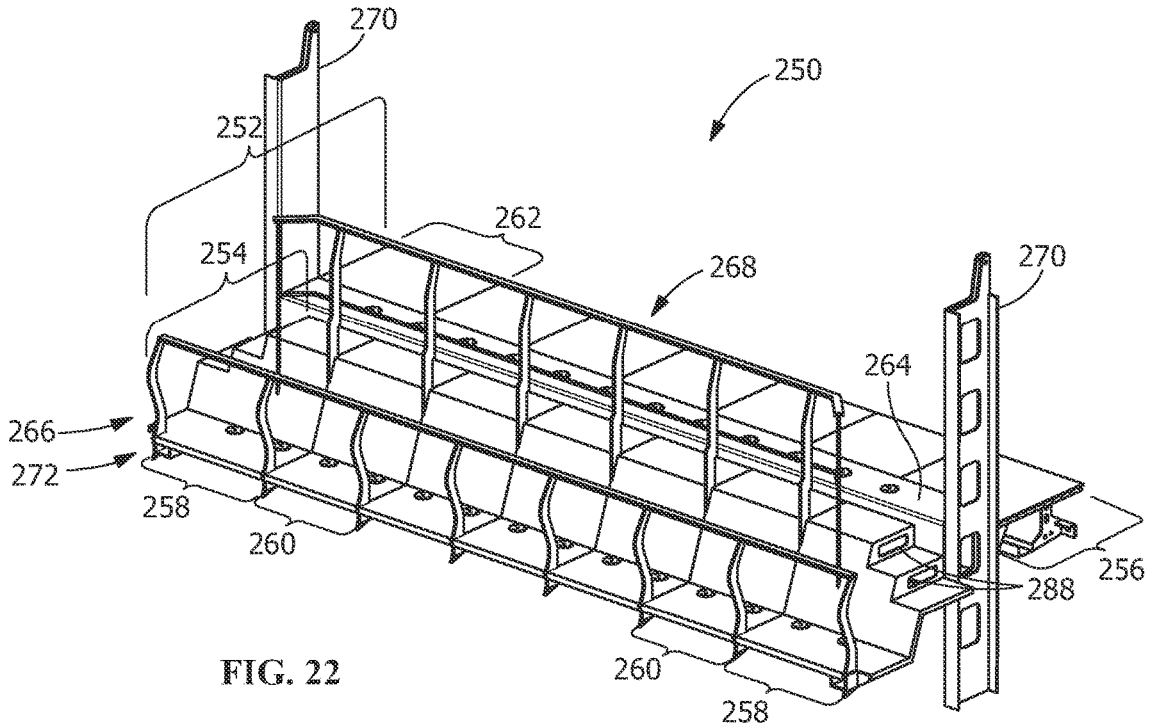
FIG. 22 is an upper perspective view of an exemplary tier section.
Figure 23:
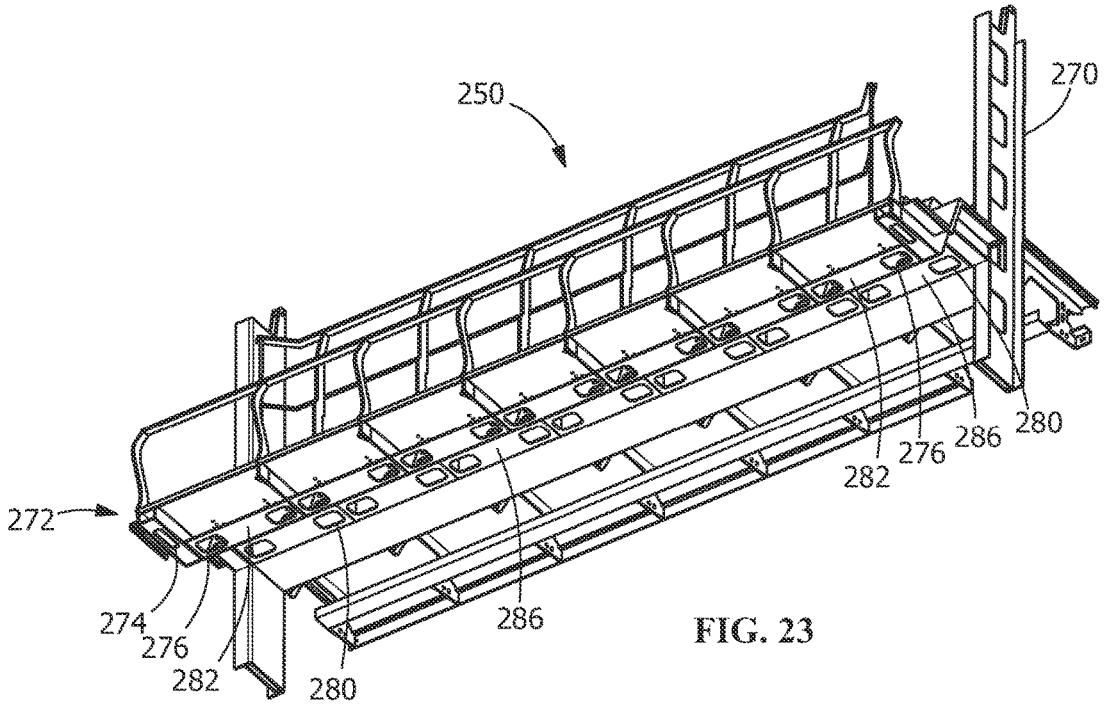
FIG. 23 is a lower perspective view of the tier section of FIG. 22.
Figure 24:
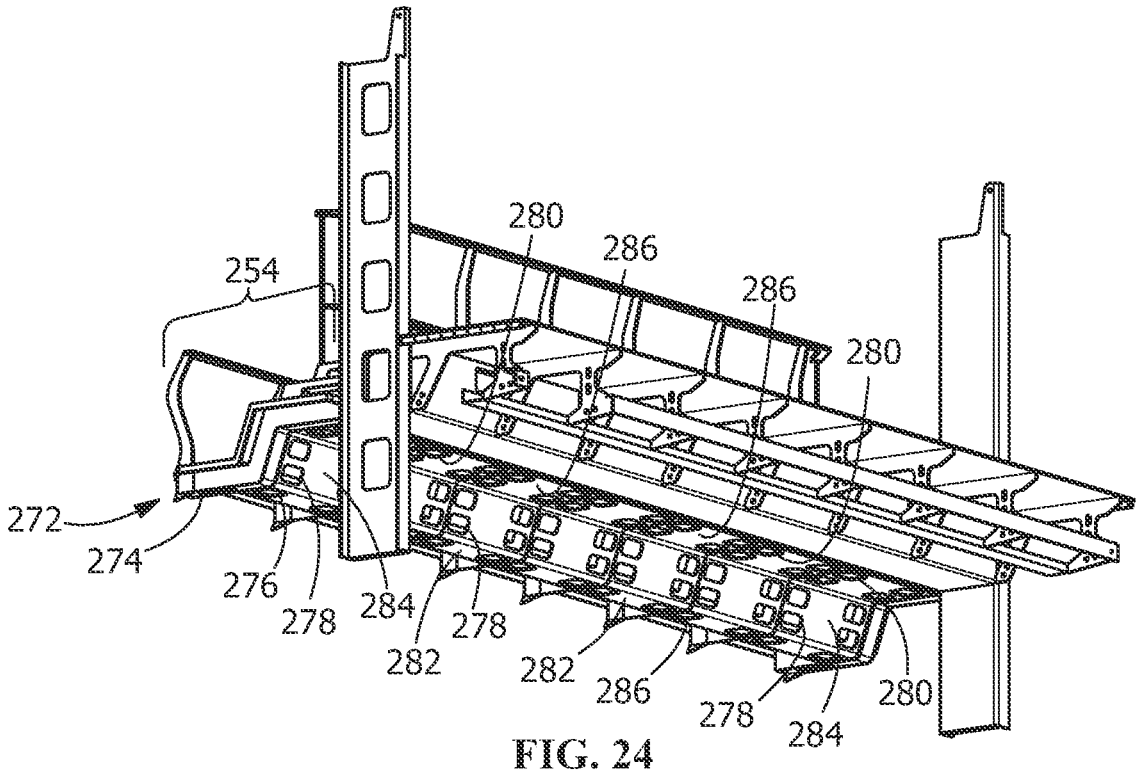
FIG. 24 is a reverse lower perspective view of the tier section of FIG. 22.
Figure 25:
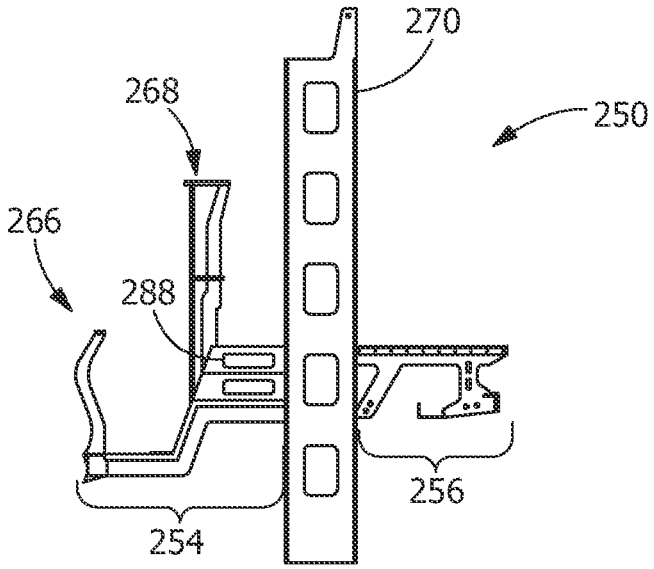
FIG. 25 is a side elevation view of the tier section of FIG. 22.

In one embodiment, as shown in FIG. 18A, tier section 211 essentially includes the combination of tier section 210 (FIG. 18) and a back wall portion 213 of the back wall 11 (FIG. 1).

FIGS. 22-25 show a tier section 250. Tier section 250 includes a longitudinal beam 264 having opposed ends that are secured to vertical beams 270. Tier section 250 further includes a tier floor 252 having a "loge" floor portion 254 and an opposed floor portion 256. Floor portions 254, 256 are secured to opposed regions, such as opposed vertical walls of longitudinal beam 264 (rectangular cross-section shown in FIG. 15 for longitudinal beam 68) such that floor portions 254, 256 are cantilevered from longitudinal beam 264. As further shown in FIG. 18, floor portion 254 includes a guardrail 266. Floor portion 256 includes a guardrail 268. Outer module 258, inner module 260, and module 262 are similar to respective modules 44, 46, 48, which discussion is not repeated herein. Box structure portion 272 is similar to box structure portion 52, which discussion is not repeated herein.

As further shown in FIGS. 22-25, the lower surfaces of modules 258, 260 are defined by panels 282, 284, 286 having respective openings 276, 278, 280. Openings 288 (FIG. 22) are also associated with the stair portion (not numbered) of module 258. Opening 274 is associated with box structure portion 272. Openings 274, 276, 278, 280, 288 are configured to permit at least one of the following: to receive illumination sources, to provide ventilation therethrough and to receive a sound generating device.

Figure 26:
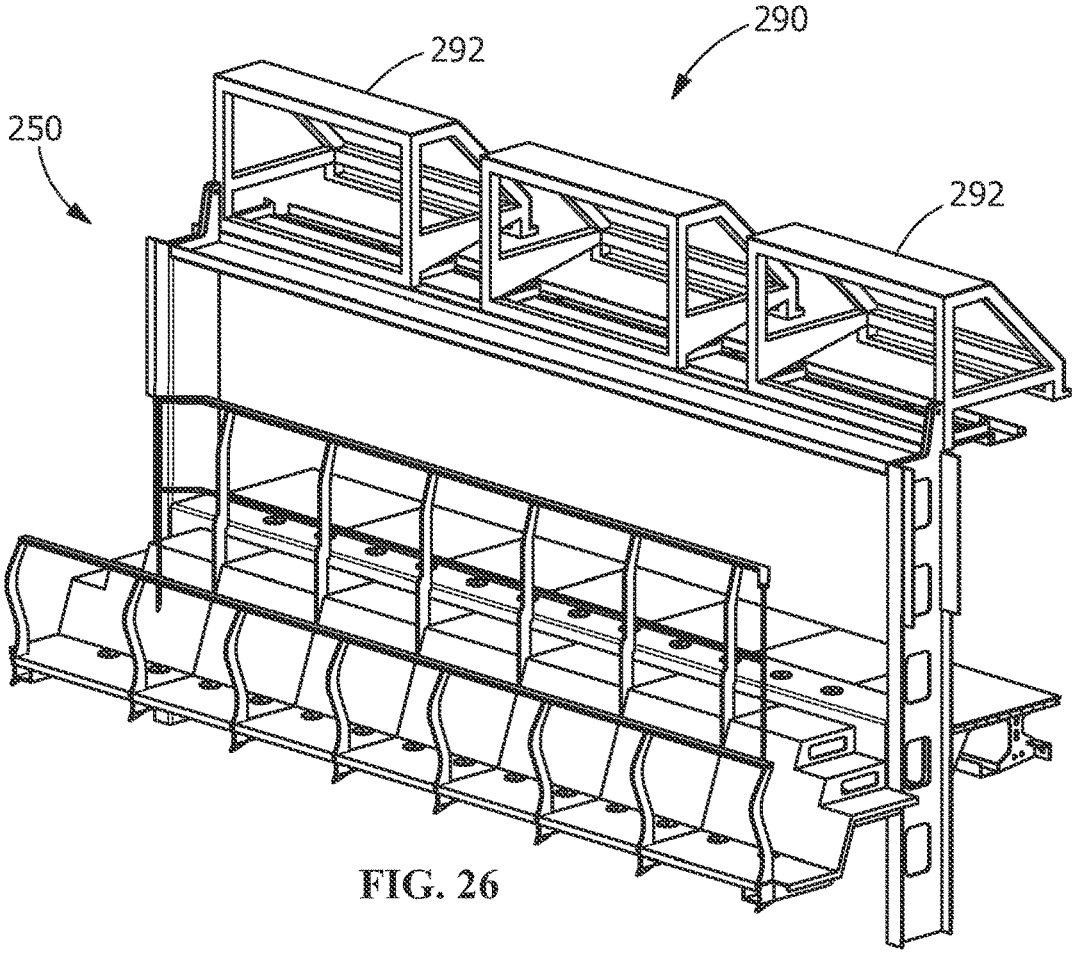
FIG. 26 is an upper perspective view of an exemplary tier section.
Figure 26A:
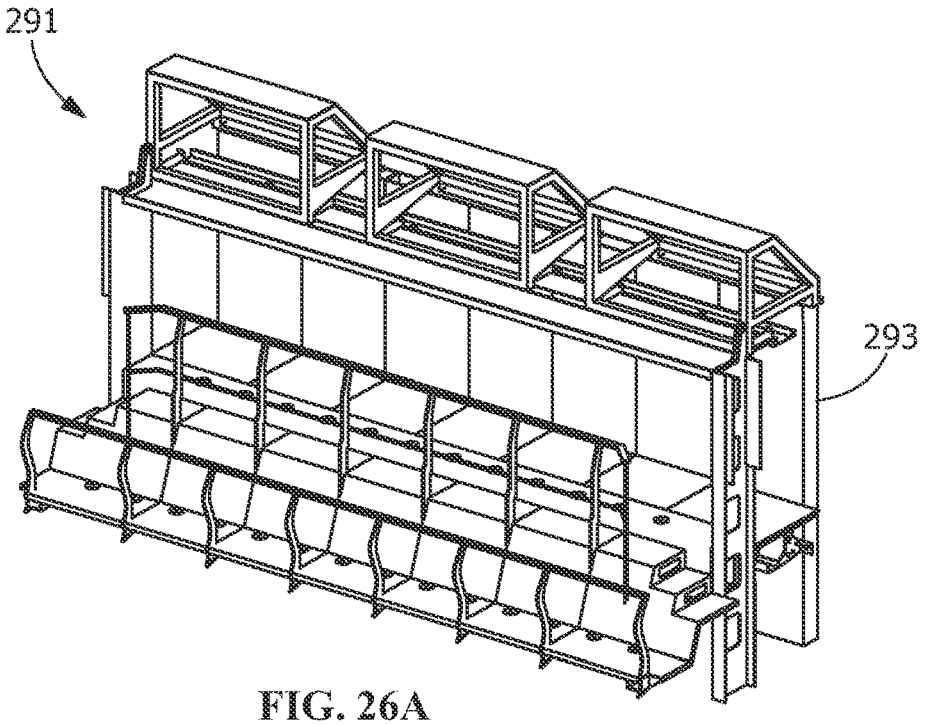
FIG. 26A is an upper perspective view of an exemplary tier section.
Figure 27:
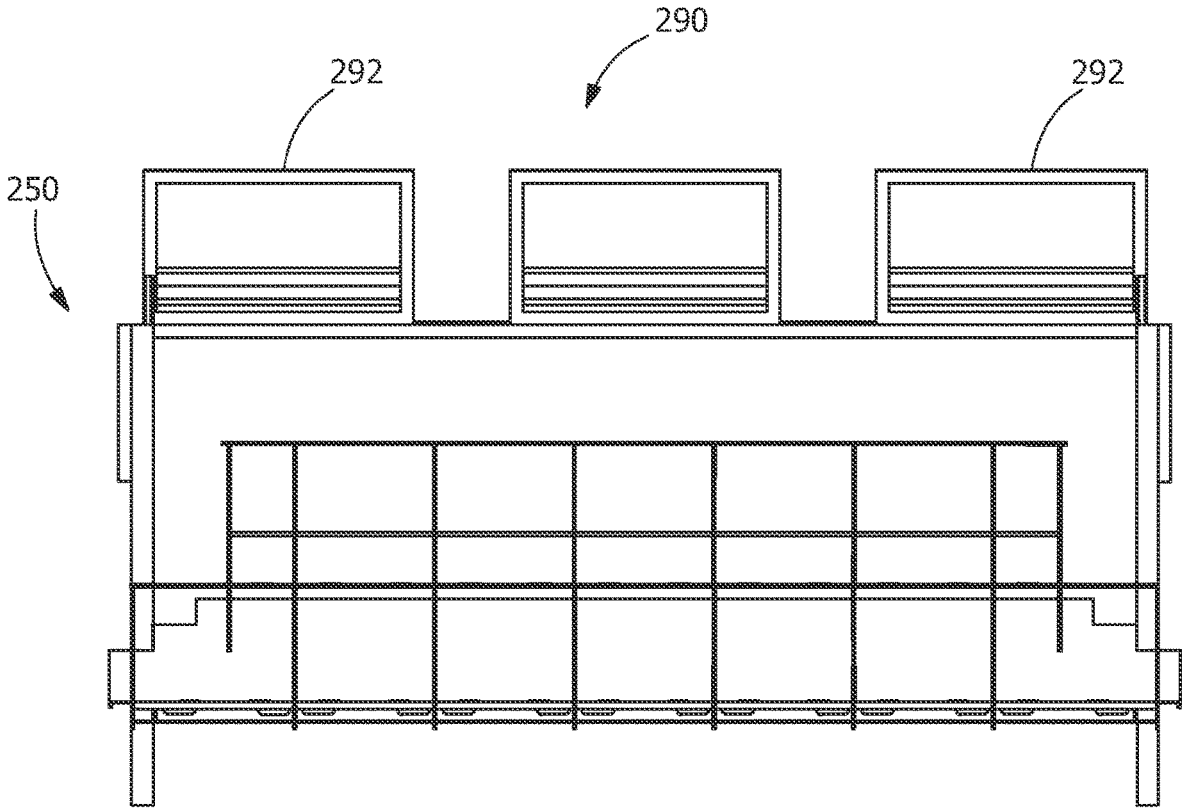
FIG. 27 is a front elevation view of the tier section of FIG. 26.

FIGS. 26-27 show a capped tier section 290, which is tier floor 252 that has been assembled and secured to caps 292. In one embodiment, as shown in FIG. 26A, tier section 291 essentially includes the combination of tier section 290 (FIG. 26) and a back wall portion 293 of the back wall 11 (FIG. 1).

Figure 28:
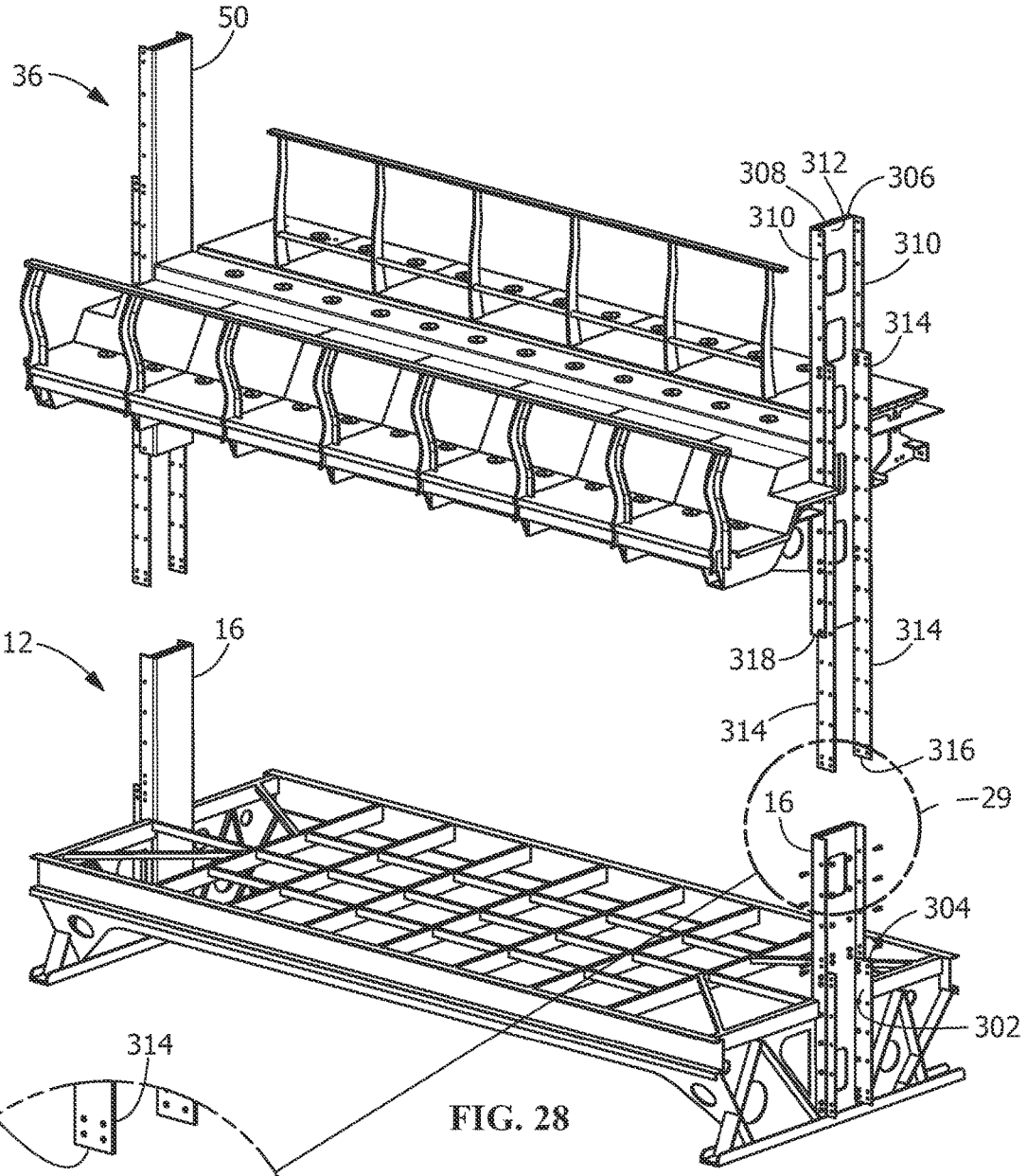
FIG. 28 is an exploded view of an assembled base portion of FIG. 2 and an assembled tier section of FIG. 7.
Figure 29:
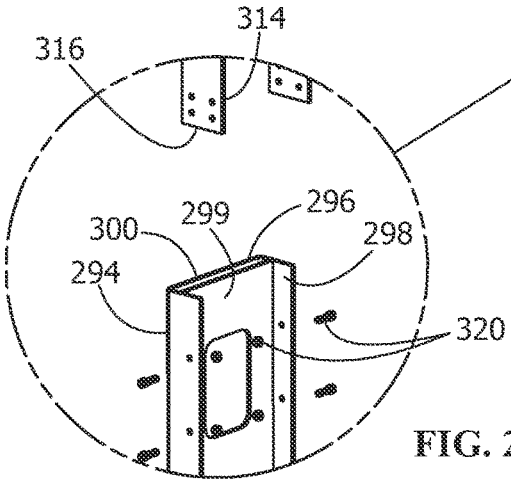
FIG. 29 is an enlarged view of region 29 taken from FIG. 28.

FIG. 28 shows an exploded view of an assembled base portion 12 (FIG. 2) and an assembled tier section 36 (FIG. 7). FIG. 29 shows an enlarged, partial view of region 29 taken from FIG. 28. As further shown in FIGS. 28-29, vertical beam 16 of base portion 12 includes a C-shaped structure or channel 294 having flanges 298 extending perpendicularly from opposed ends of web 296. C-shaped channel 294 has an end 300 and includes a stiffener 299 extending between and secured to opposed flanges 298. As further shown in FIGS. 28-29, a lower portion of C-shaped channel 294 includes a flange extension 302 secured to and extending outwardly from each of flanges 298. Flange extension 302 has an end 304 that is different from end 300 of C-shaped channel 294.

Similarly, as shown in FIG. 28, vertical beam 50 of tier section 36 includes a C-shaped structure or channel 306 having flanges 310 extending perpendicularly from opposed ends of web 308. C-shaped channel 306 has an end 318 and includes a reinforcing plate 312 extending between and secured to opposed flanges 310. As further shown in FIGS. 28-29, a lower portion of C-shaped channel 306 includes a flange extension 314 secured to and extending outwardly from each of flanges 310. Flange extension 314 has an end 316 that is different from end 318 of C-shaped channel 306.

Figure 30:
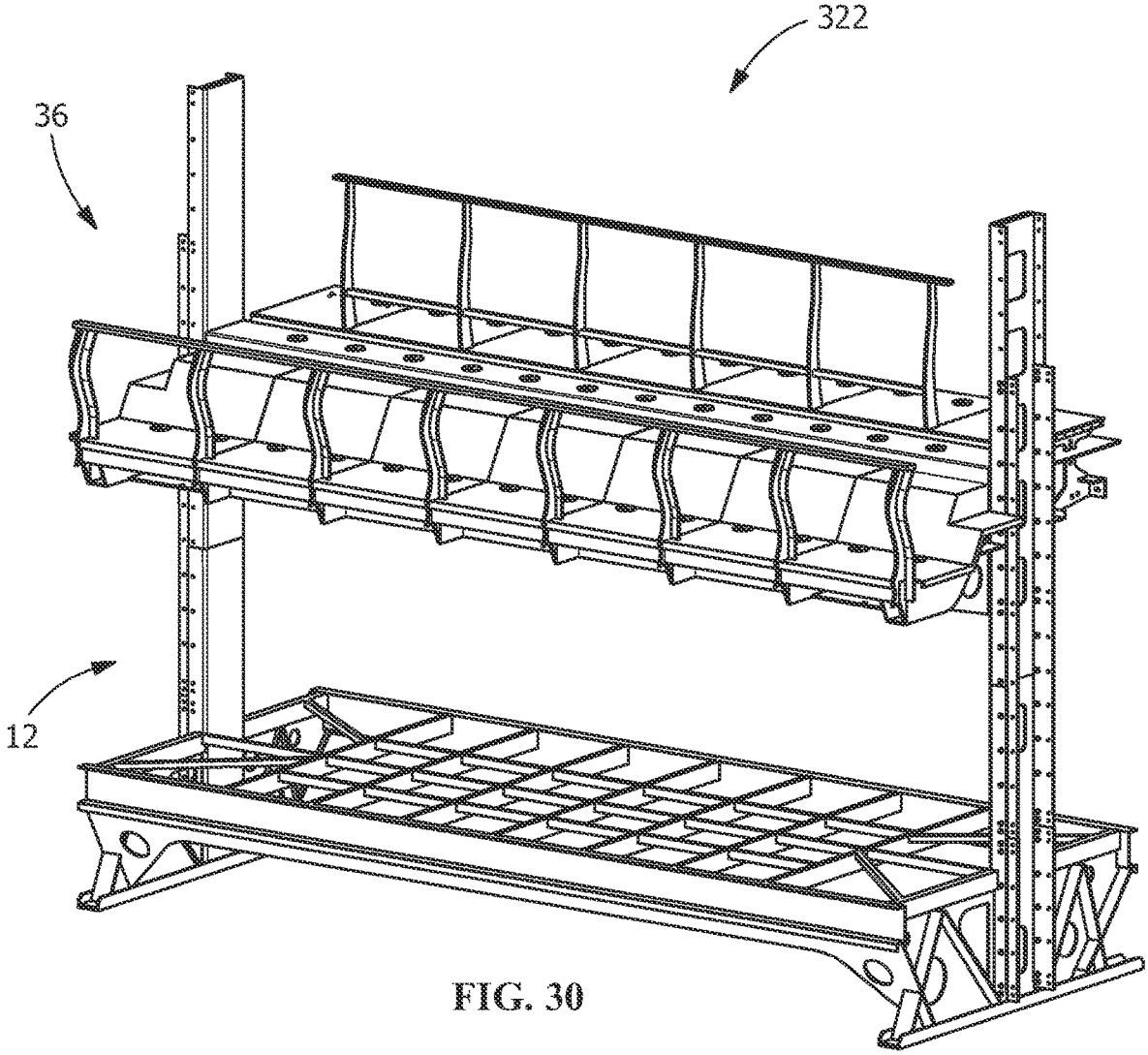
FIG. 30 is an upper perspective view of an exemplary nominal inventory portion segment resulting from assembly of the base portion and tier section of FIG. 28.
Figure 30A:
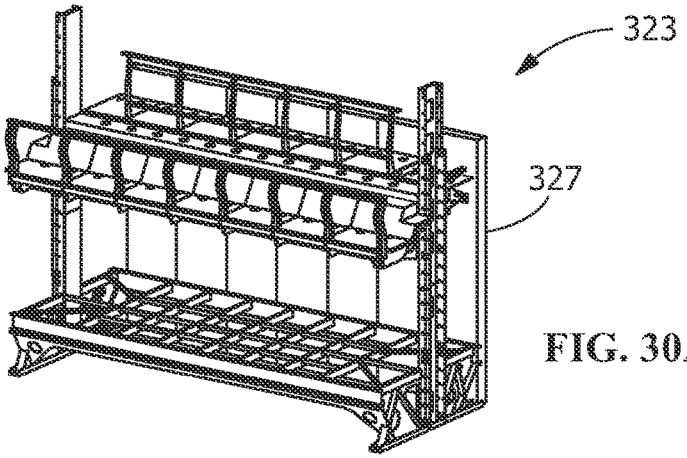
FIG. 30A is an upper perspective view of an exemplary nominal inventory portion segment resulting from assembly of the base portion and tier section of FIG. 28.

In order to assemble and secure vertical beam 50 to vertical beam 16 after aligning the beams as shown in FIG. 28, vertical beam 50 is lowered into contact with vertical beam 16. That is, ends 316 of flange extensions 314 are brought into contact with corresponding ends 304 of flange extensions 302. Simultaneously, ends 318 of C-shaped channel 306 are brought into contact with corresponding ends 300 of C-shaped channel 306. Once the corresponding flange extensions and C-shaped channels are brought into contact, openings (not numbered) formed in the flange extensions are aligned, and fasteners 320 are installed. By virtue of this arrangement, the vertical beams of base portion 12 and tier section 36 can be secured to each other without requiring welding, saving significant assembly time. FIG. 30 is an upper perspective view of a nominal inventory portion segment 322, resulting from assembly of base portion 12 and tier section 36. In one embodiment, as shown in FIG. 30A, nominal inventory portion segment 323 essentially includes the combination of nominal inventory portion segment 322 (FIG. 30) and a back wall portion 327 of back wall 11 (FIG. 1).

Figure 31:
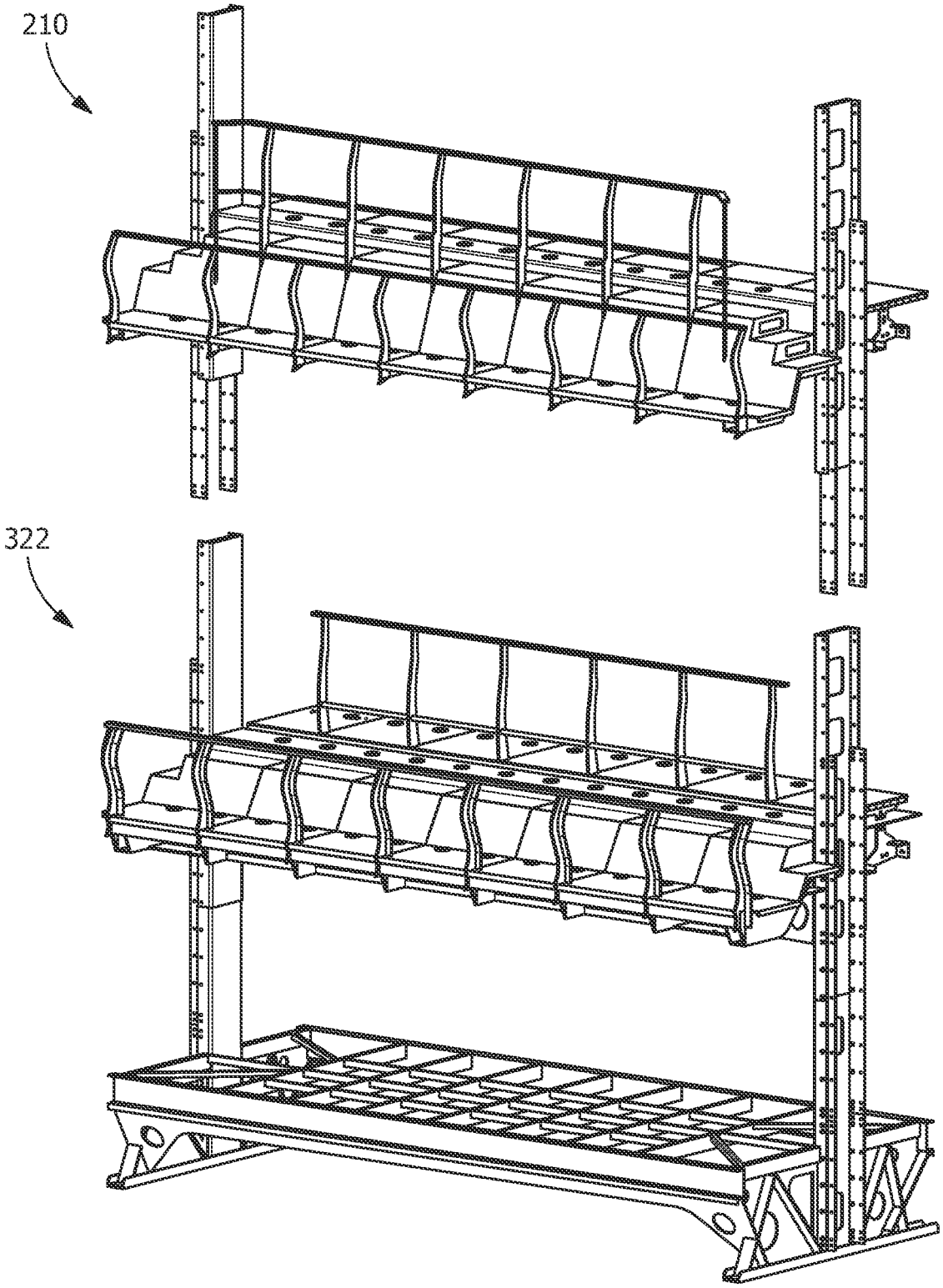
FIG. 31 is an exploded view of an assembled nominal inventory portion segment of FIG. 30 and an assembled tier section of FIG. 18.
Figure 32:
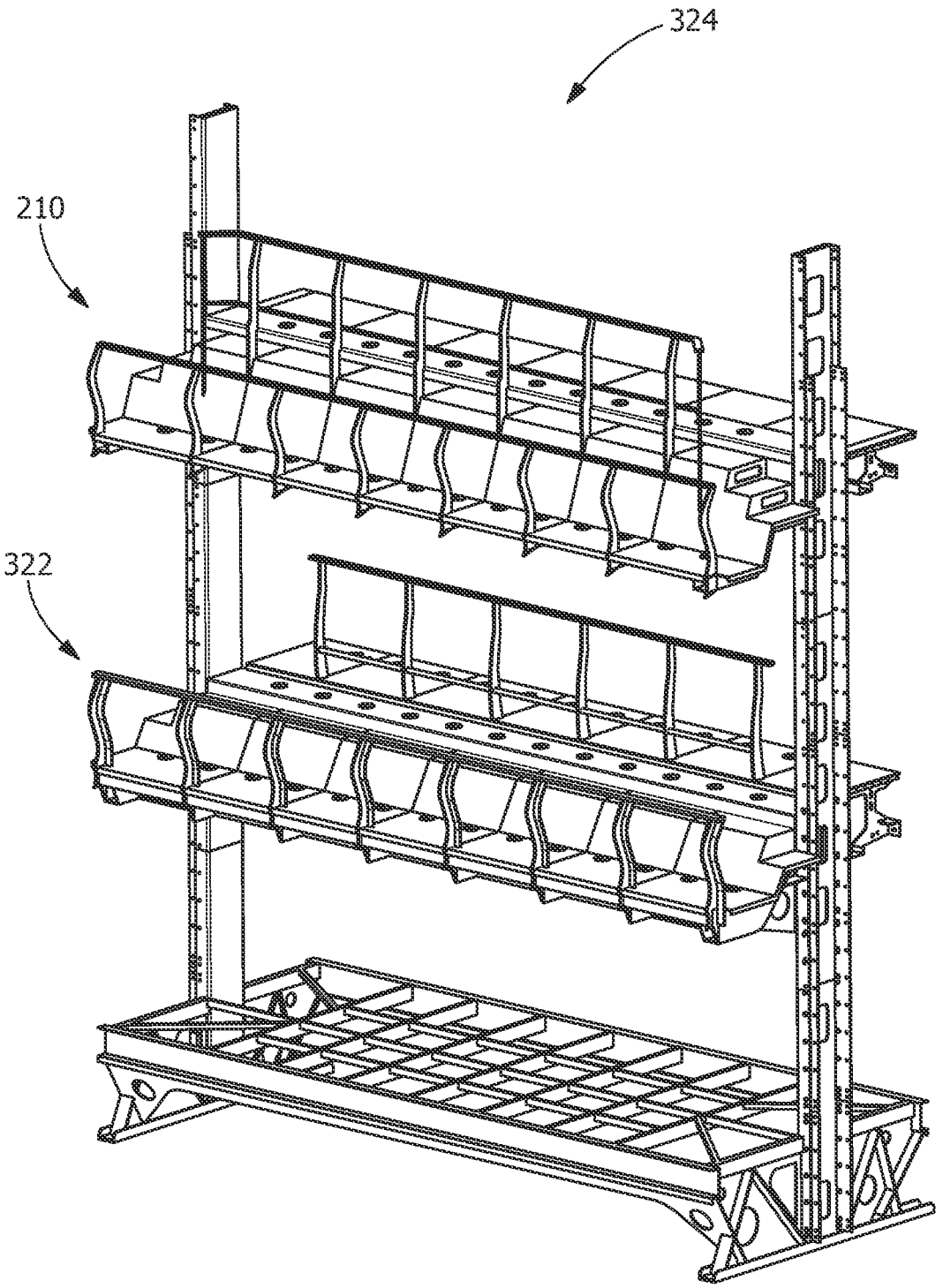
FIG. 32 is an upper perspective view of an exemplary nominal inventory portion segment resulting from assembly of the nominal inventory portion segment and tier portion of FIG. 31.
Figure 32A:
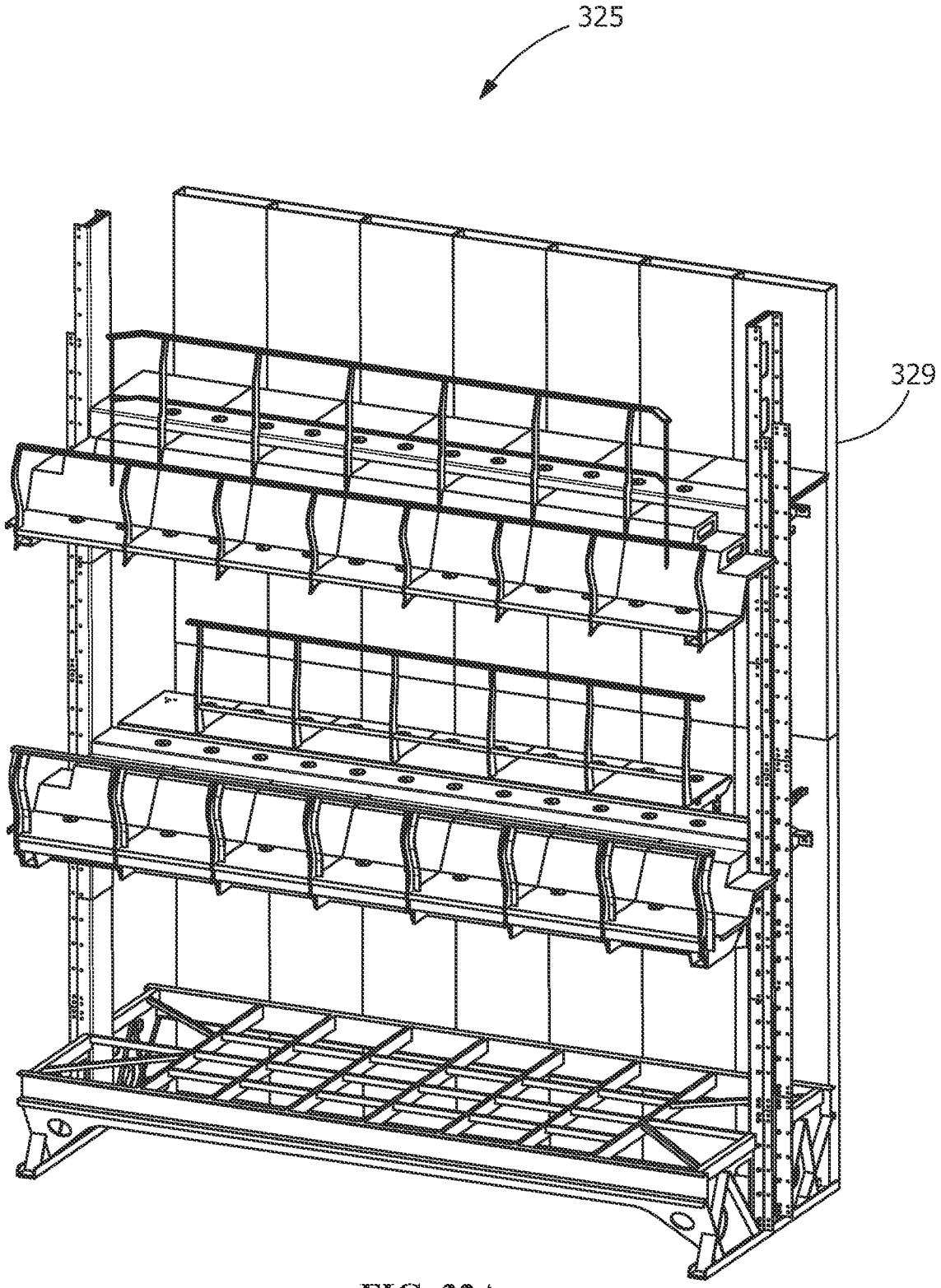
FIG. 32A is an upper perspective view of an exemplary nominal inventory portion segment resulting from assembly of the nominal inventory portion segment and tier portion of FIG. 31.

FIG. 31 shows an exploded view of assembled nominal inventory portion segment 322 (FIG. 30) and an assembled tier section 210 (FIG. 18). FIG. 32 shows an upper perspective view of nominal inventory portion segment 324 resulting from assembly of nominal inventory portion segment 322 and tier section 210. In one embodiment, as shown in FIG. 32A, nominal inventory portion segment 325 essentially includes the combination of nominal inventory portion segment 324 (FIG. 32) and a back wall portion 329 of the back wall 11 (FIG. 1).

Figure 33:
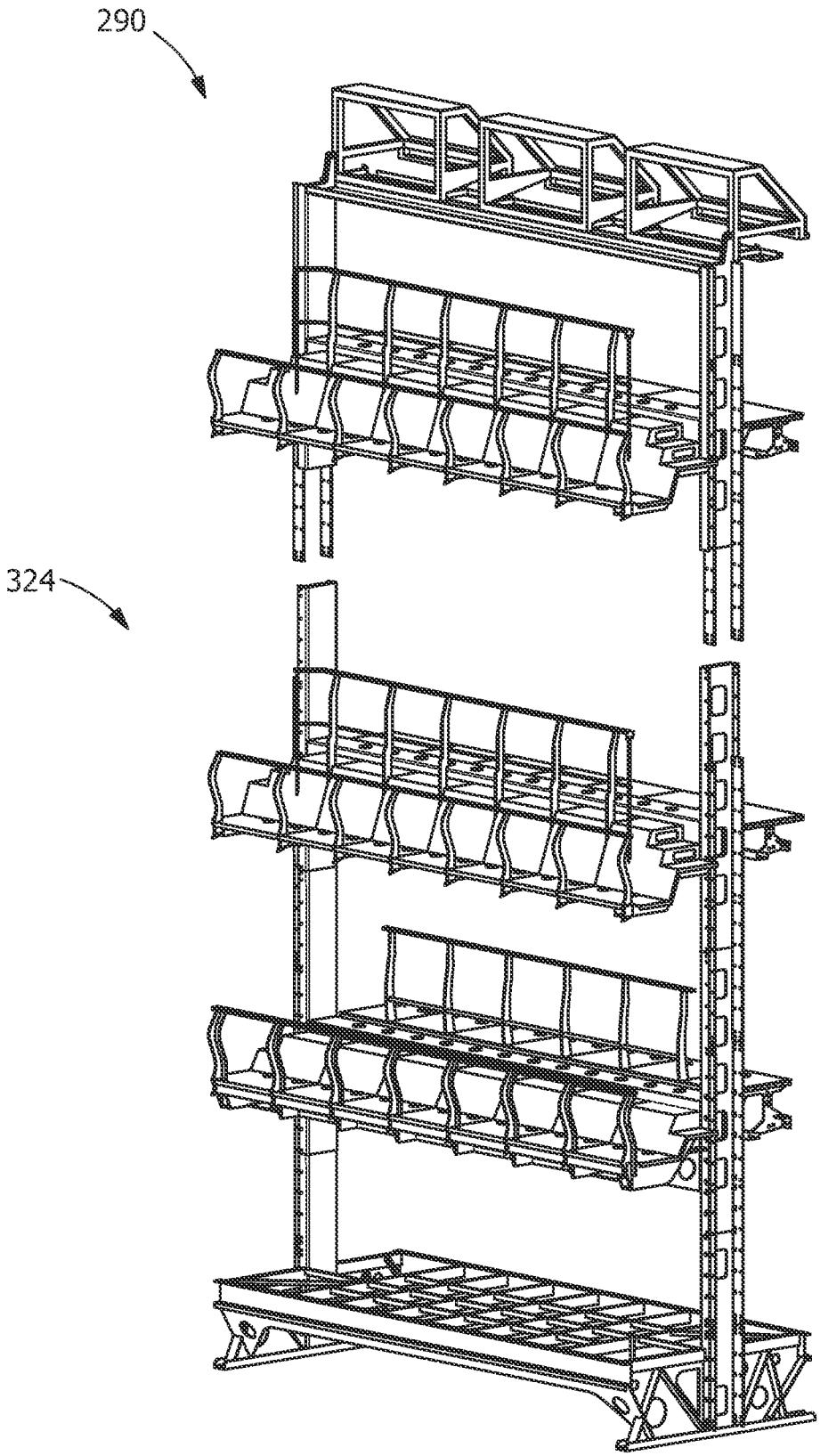
FIG. 33 is an upper perspective view of an assembled tier section of FIG. 26 and an assembled nominal inventory portion segment of FIG. 32.
Figure 34:
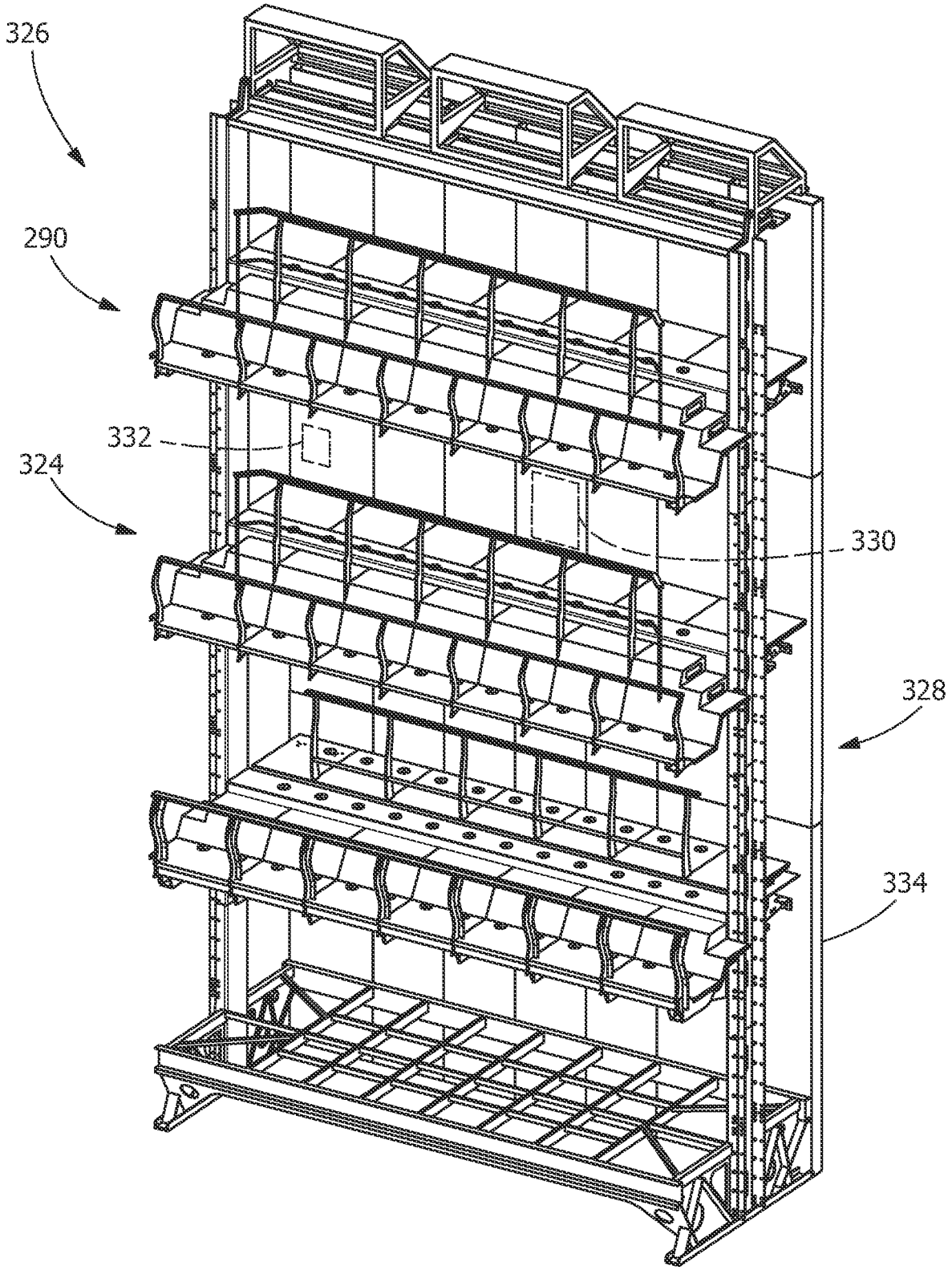
FIG. 34 is an upper perspective view of an exemplary nominal inventory portion segment resulting from assembly of the tier section and nominal inventory portion segment of FIG. 33.

FIG. 33 shows an upper perspective view of an assembled capped tier section 290 (FIG. 26) and an assembled nominal inventory portion segment 324 (FIG. 32). FIG. 34 shows an upper perspective view of nominal inventory portion segment 326 resulting from assembly of tier section 290 and nominal inventory portion segment 324 (FIG. 33). In an alternate embodiment, nominal inventory portion segment 326 further includes back wall 328, including back wall portion 334. Openings can be formed in back wall 328 as needed, such as opening 330 to provide ingress/egress to the tier sections by patrons and opening 332 to provide ventilation or openings provided for other reasons.

Figure 35:
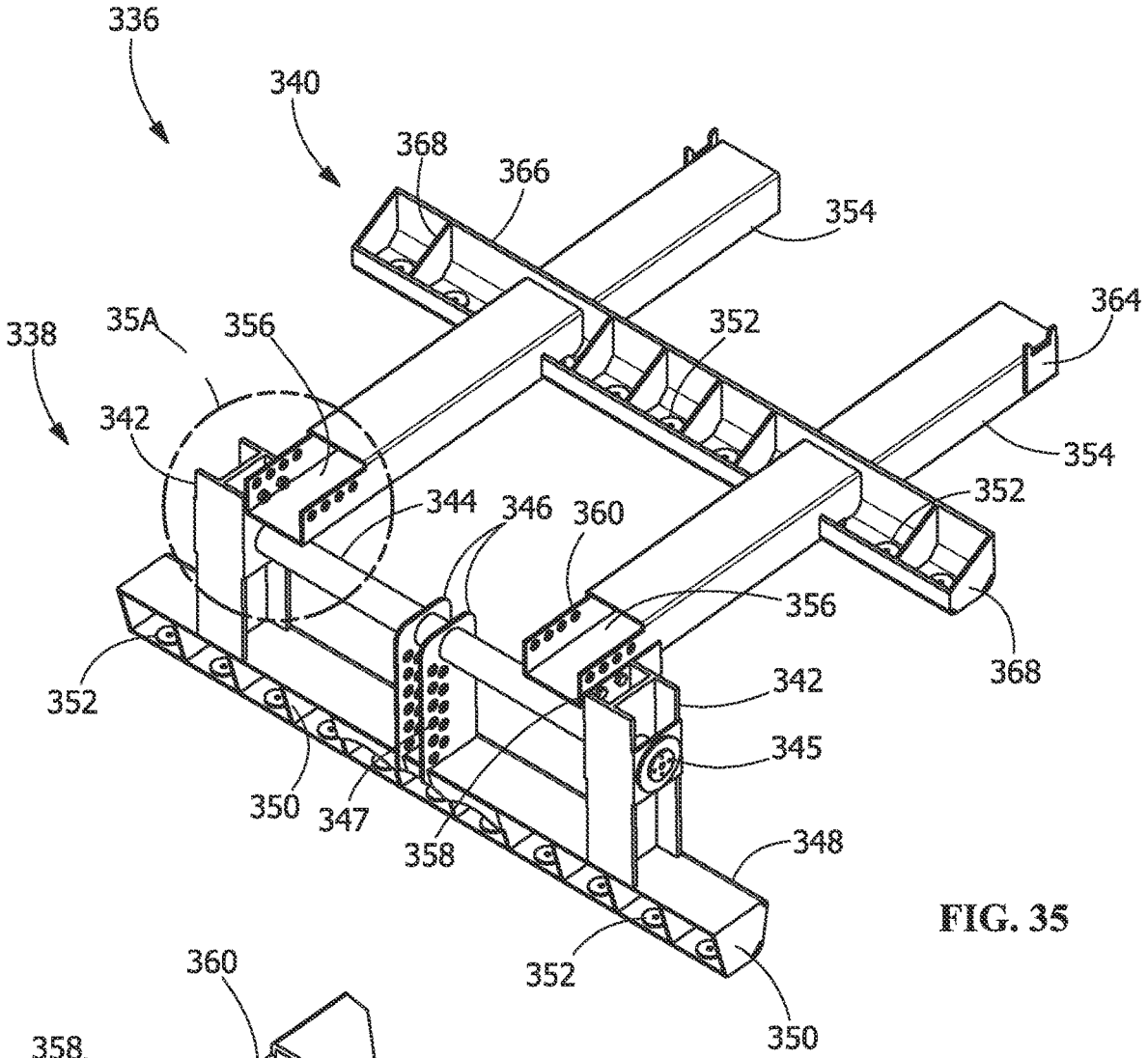
FIG. 35 is an upper perspective view of an exemplary lifting fixture.
Figure 35A:
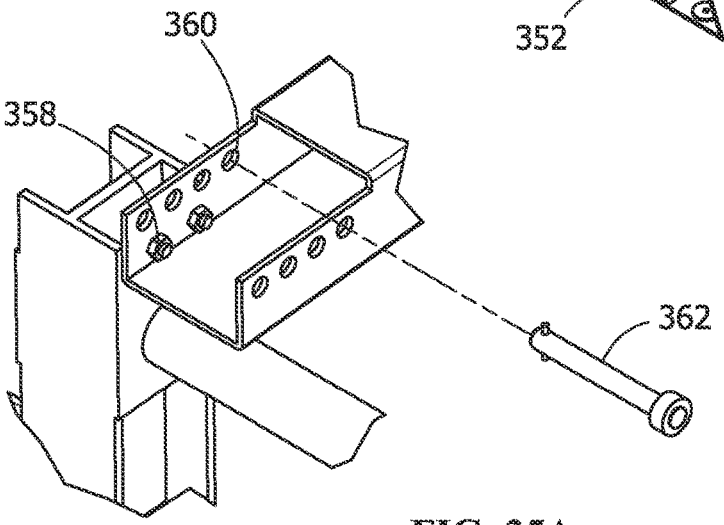
FIG. 35A is an enlarged, partial view taken from region 35A of FIG. 35.
Figure 37:
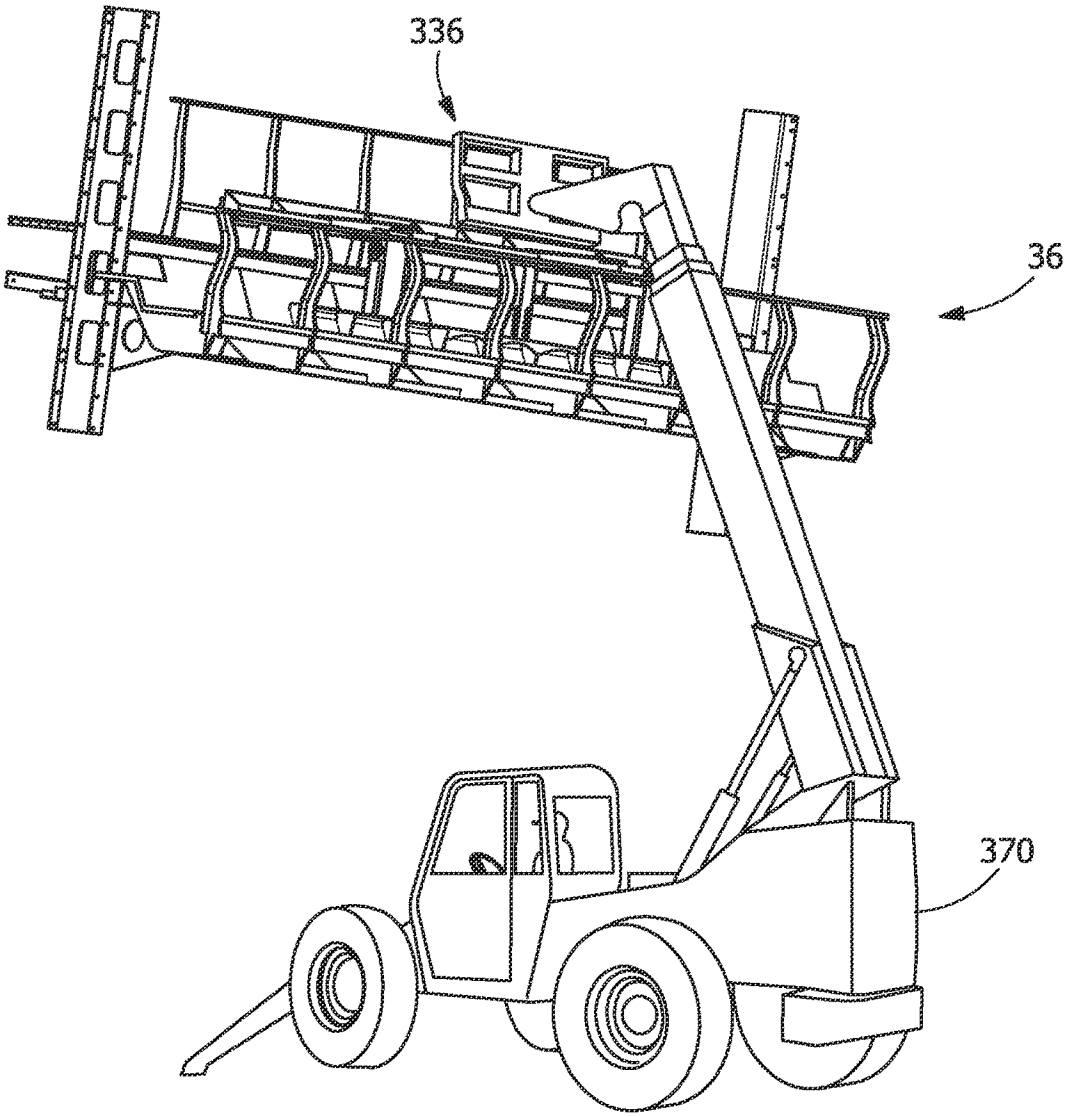
FIG. 37 is a lower perspective view of an exemplary forklift machine transporting the tier section and the lifting fixture of FIG. 36.

FIG. 35 shows an L-shaped lifting fixture 336 having fixture portions 338, 340. Fixture portion 338 includes a pair of beams 342 extending perpendicularly from opposed ends of a tube 344. Beams 342 each have a handling interface 345 that is aligned with tube 344. Tube 344 includes a pair of reinforcing members 346 secured near the center of tube 344, which reinforcing members 346 including handling features 347 to permit handling of lifting fixture 336. One end of beams 342 and reinforcing members 346 are secured to a cross member 348 which includes stiffeners 350. Cross member 348 includes an open end for permitting access to a plurality of lifting interfaces 352 to permit lifting of a tier section. The ends of beams 342 adjacent to tube 344 includes openings to receive fasteners 358 for securing fixture portion 338 with one end of tubes 354 of fixture portion 340. Selectably removable fasteners 358 permit separation of fixture portion 338 from fixture portion 340, permitting installation of the lifting fixture with a tier section. The end of tubes 354 secured to fixture portion 338 include a recess 356 to more easily receive forks of a fork lifting or forklift machine 370 (FIG. 37). Retention features 360 formed in close proximity to recess 356 are configured to receive a retention member 362 (FIG. 35A) for retaining the forks of the fork lifting machine in tubes 354. Adjacent the opposite ends of tubes 354 are alignment/orientation features 364 for aiding with alignment and orientation of fixture portion 340. Fixture portion 340 further includes a cross member 366 that is secured to tubes 354. Cross member 366 includes a plurality of stiffeners 368 and has an open end for permitting access to a plurality of lifting interfaces 352 to permit lifting of a tier section.

Figure 36:
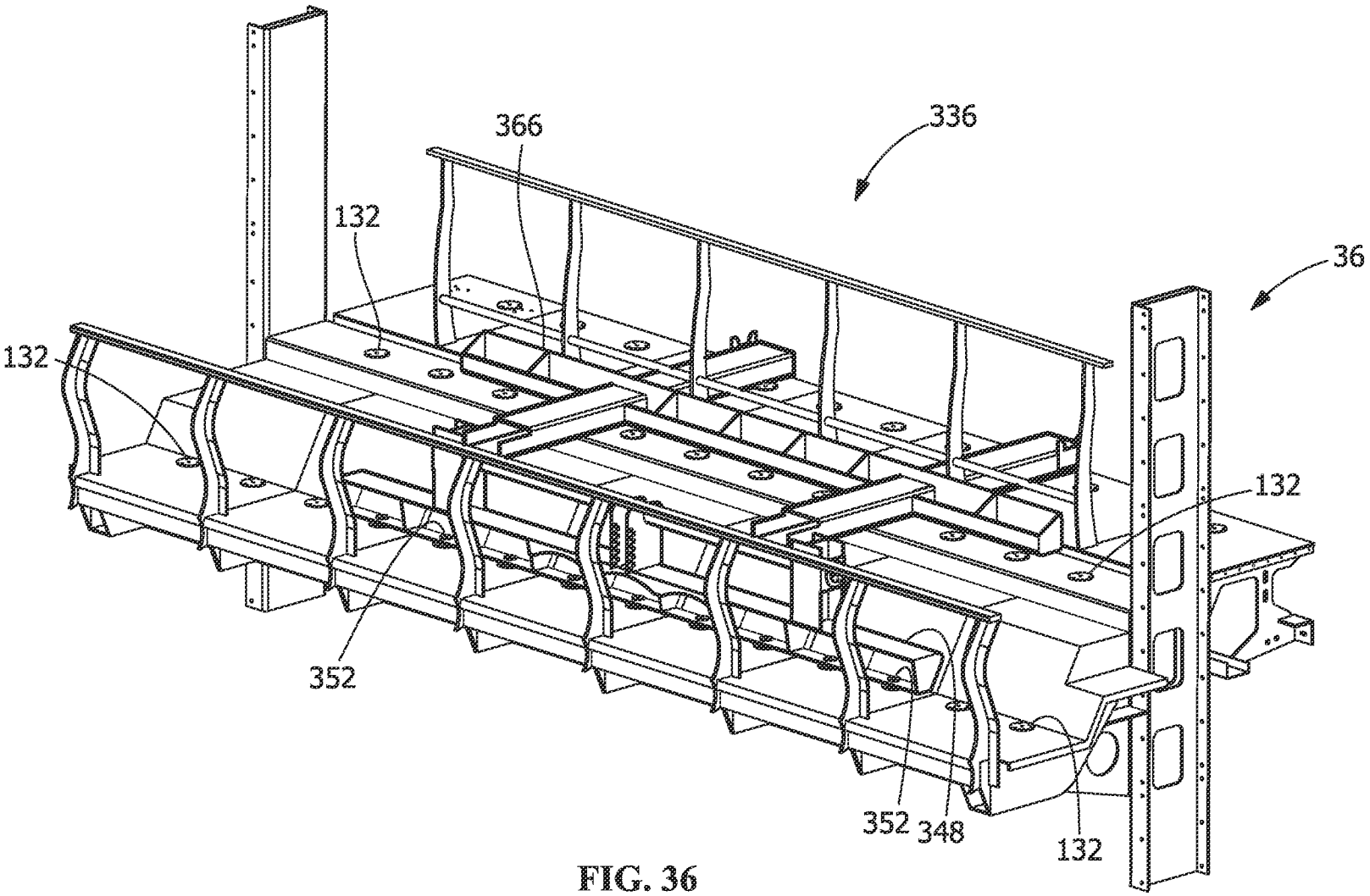
FIG. 36 is an upper perspective view of the lifting fixture of FIG. 35 secured to an exemplary tier section.

FIG. 36 shows lifting fixture 336 in an installed position with each of cross members 348, 366 positioned such that lifting interfaces 352 of the lifting fixture are aligned with corresponding chair/lifting interfaces 132 of a tier section, such as tier section 36. FIG. 37 shows a forklift machine 370 lifting/manipulating tier section 36 by virtue of the fork lifting tines of the fork lifting machine engaged with lifting fixture 336.

Figure 38:
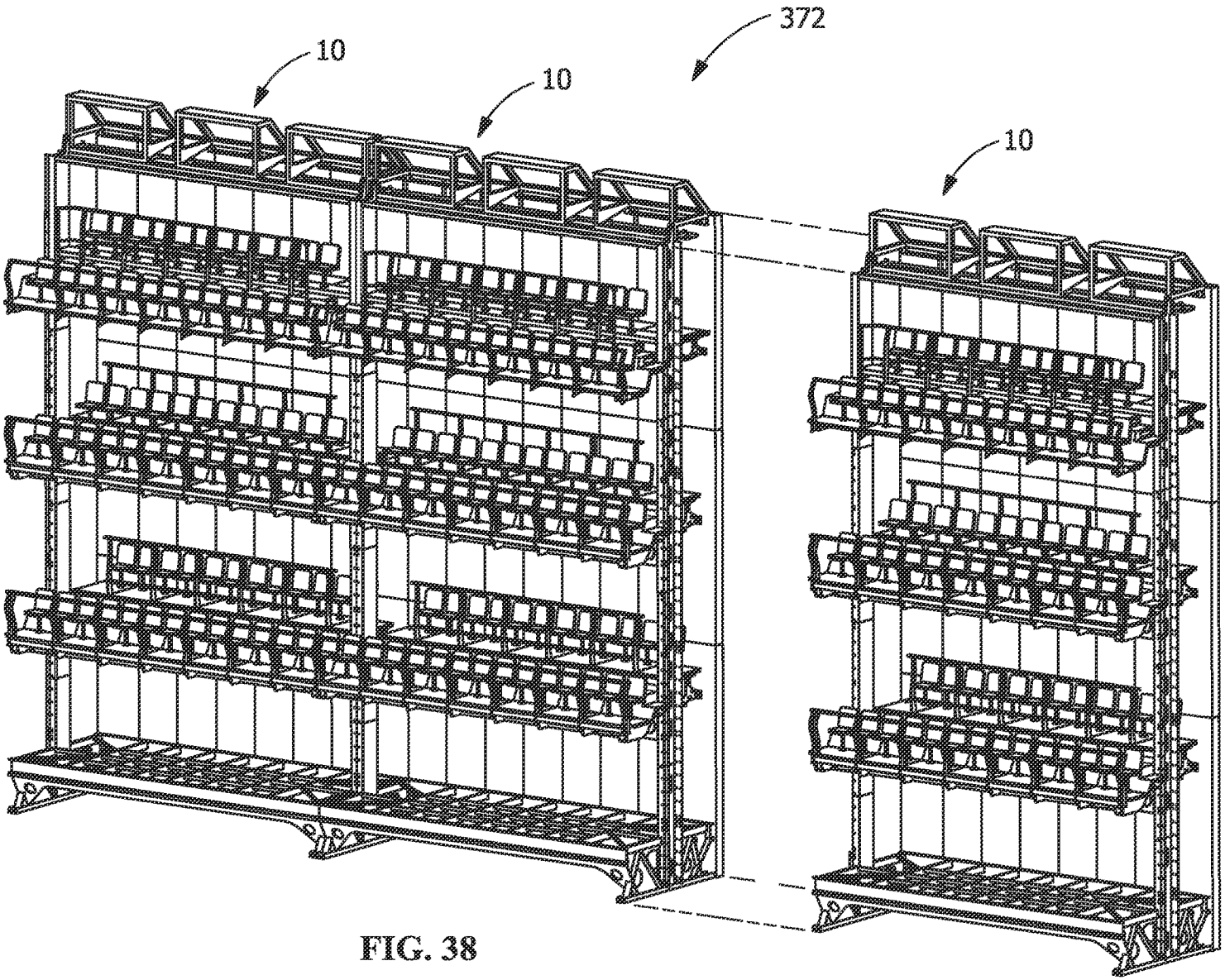
FIG. 38 is an exemplary modular auditorium.

FIG. 38 shows a modular auditorium MOD-AD 372 comprised of a plurality of nominal inventory portions 10. In one embodiment, a single nominal inventory portion 10 can define the modular auditorium MOD-AD.

Figure 39:
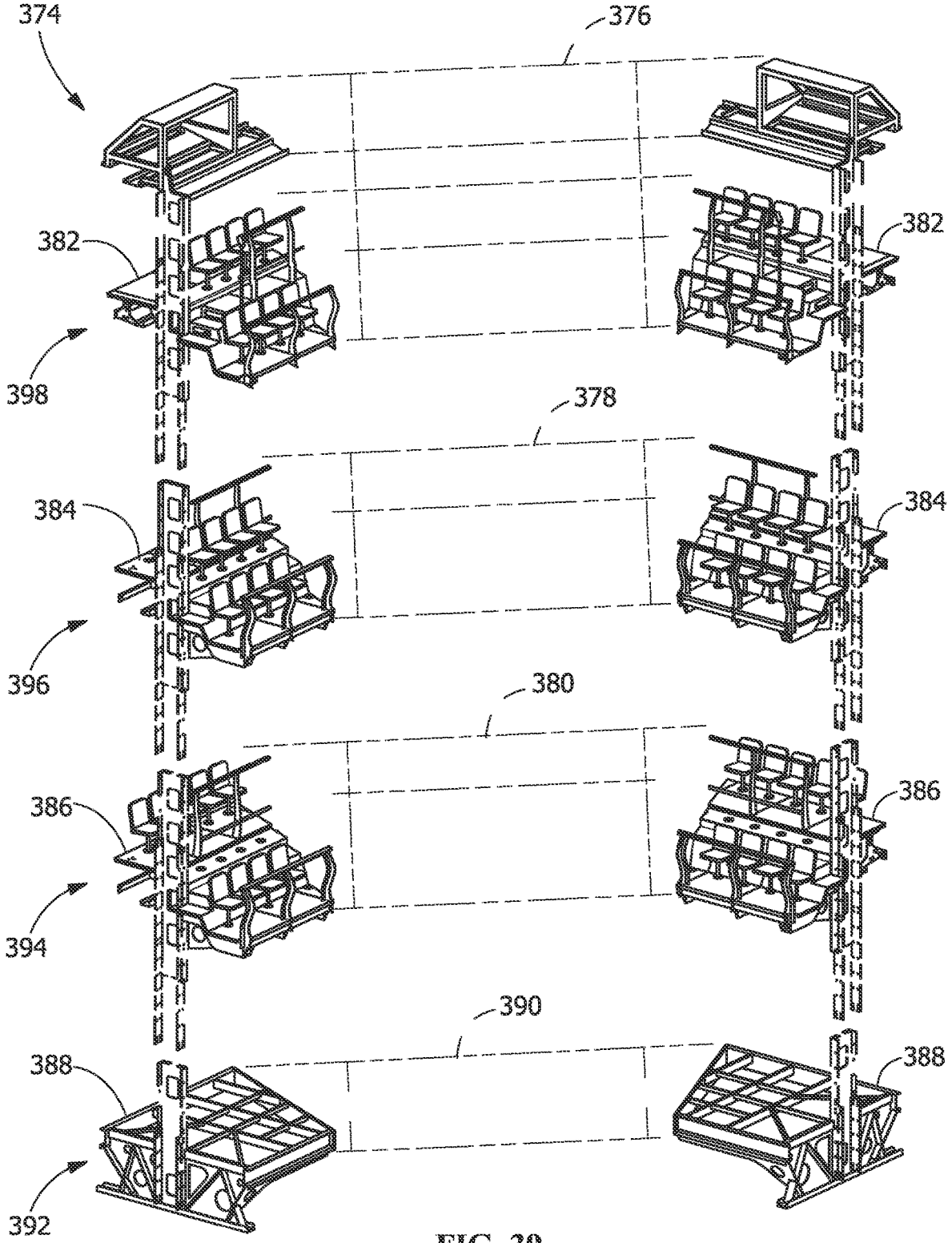
FIG. 39 is an exemplary nominal inventory portion.
Figure 40:
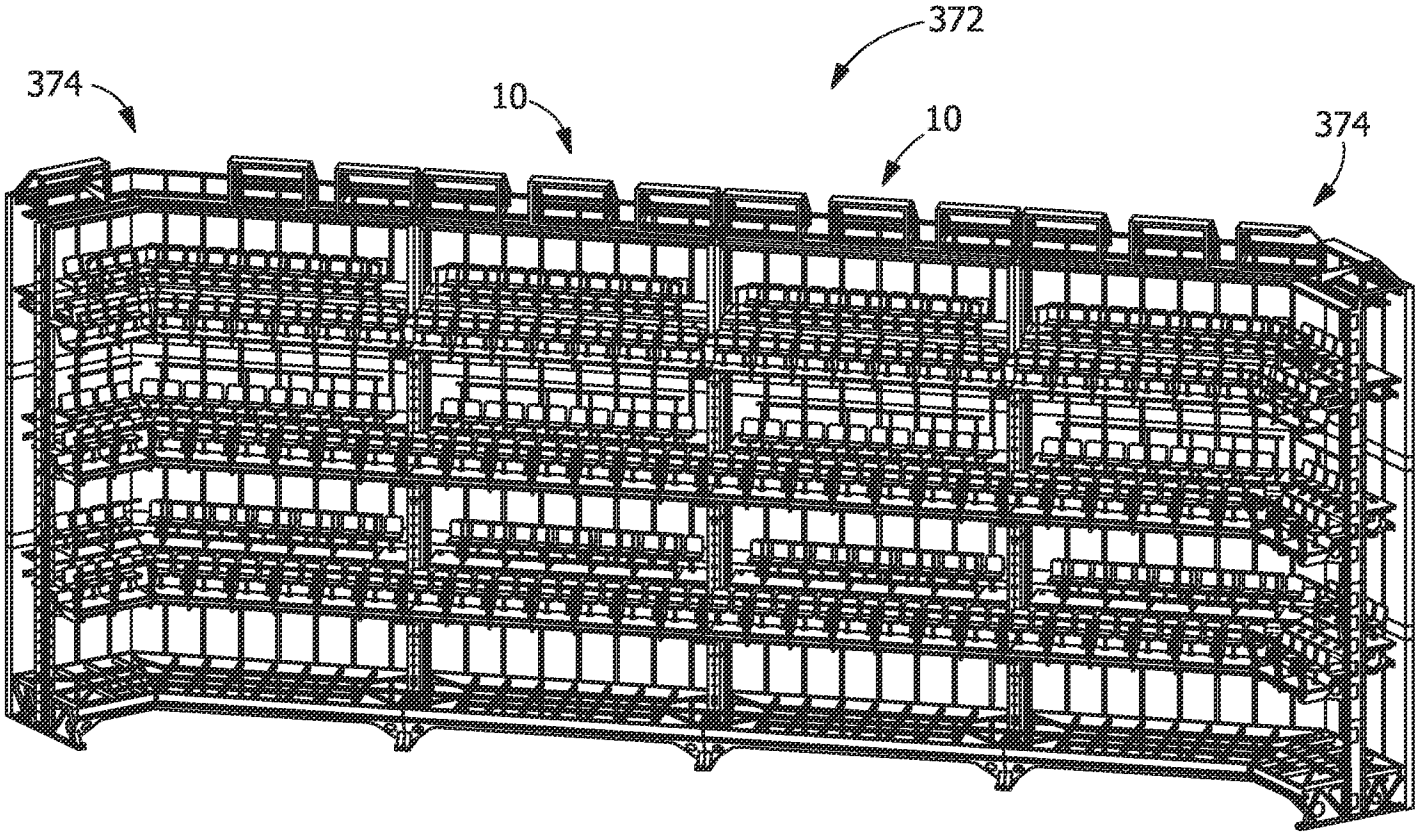
FIG. 40 is an exemplary modular auditorium.

FIG. 39 shows an alternate configuration of a nominal inventory portion, such as corner nominal inventory portion 374. As shown in FIG. 39, corner nominal inventory portion 374 includes a base portion 392 and tier sections 394, 396, 398 assembled together. Base portion 392 includes a pair of wedge-shaped base portions 388 secured to opposed ends of a frame portion 390. Tier section 394 includes a pair of wedge-shaped modular sections 386 secured to opposed ends of a modular section 380, such as a segment of tier section 36 (FIG. 1). Tier section 396 includes a pair of wedge-shaped modular sections 384 secured to opposed ends of a modular section 378, such as a segment of tier portion 210 (FIG. 1). Tier section 398 includes a pair of wedge-shaped modular sections 382 secured to opposed ends of a modular section 376, such as a segment of tier portion 290 (FIG. 1). In this construction, corner nominal inventory portion 374 can define a 90 degree angle between opposed vertical beams (collectively shown in phantom line). In one embodiment, the corner nominal inventory portion can define a degree angle other than 90 degrees between opposed vertical beams. In one embodiment, wedge-shaped modules for the same tier section can be different from one another. With the construction such as shown in FIG. 39, it is possible to form a modular auditorium MOD-AD defining a closed geometry, such as a rectangle surrounding a performance space. In one embodiment, such as shown in FIG. 40 for modular auditorium MOD-AD 372, each corner nominal inventory portion 374 only includes a single set or combination of wedge-shaped base portions 388 and wedge-shaped modules 382, 384, 386 (FIG. 39).

Figure 41:
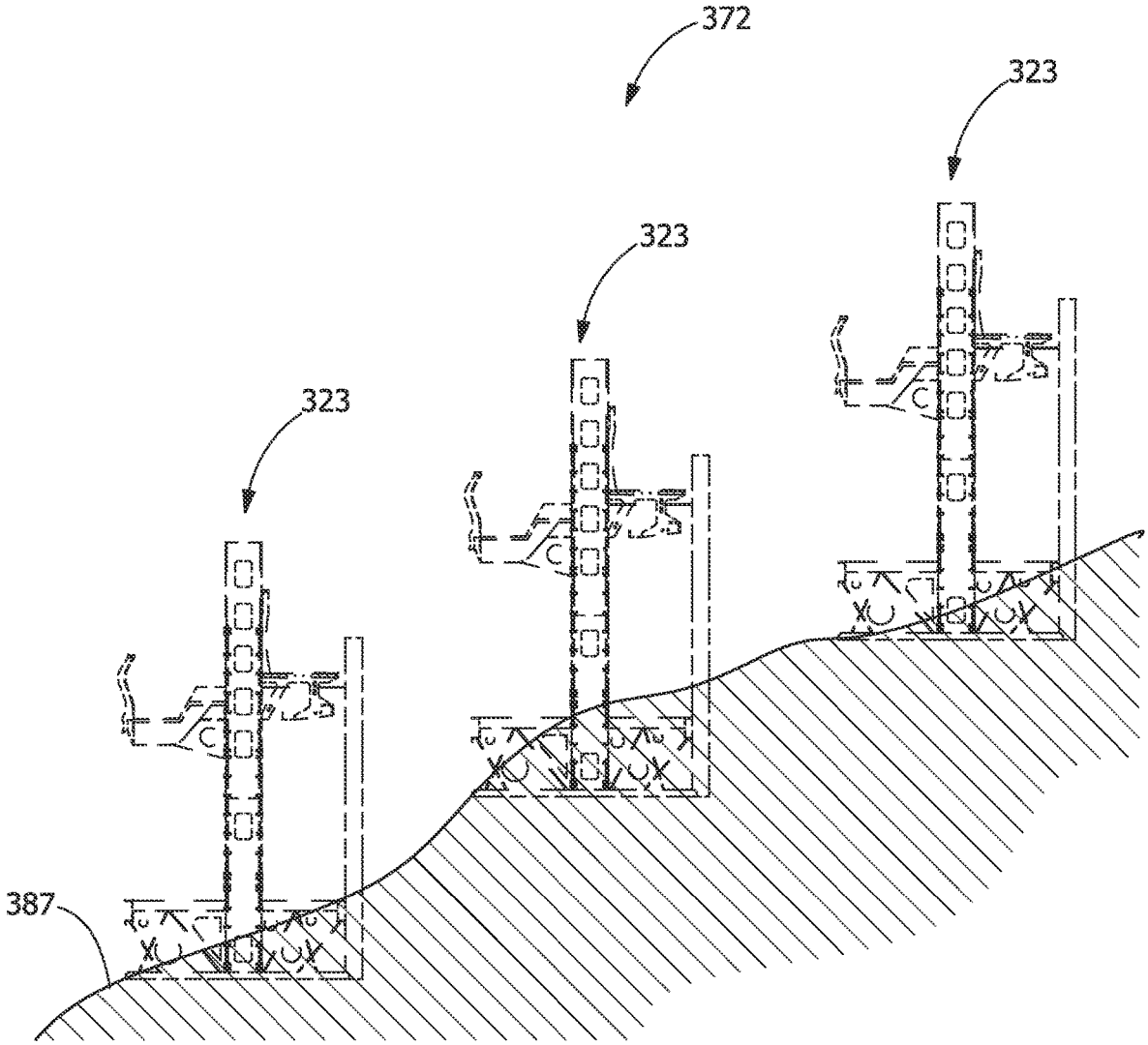
FIG. 41 is an exemplary modular auditorium.

FIG. 41 shows a modular auditorium MOD-AD comprised of a plurality of nominal inventory portion segments 323 positioned at different locations along a sloped surface 387.

It is to be understood that seat density is increased due to the reduced vertical distance between adjacent tier sections, as a result of the reduced vertical distance between adjacent tier sections, due to the "loge" or multilevel floor portions having a front row of seating that is lower than the second row of seating for each of tier sections 36, 210, 290 (see FIG. 1).

In one embodiment, the back wall, such as back wall 11 (FIG. 1) can be of unitary construction and provided separately from the tier sections.

It is to be understood that the modular auditorium MOD-AD of the present invention can include more than three tier sections, if desired.

Figure 44:
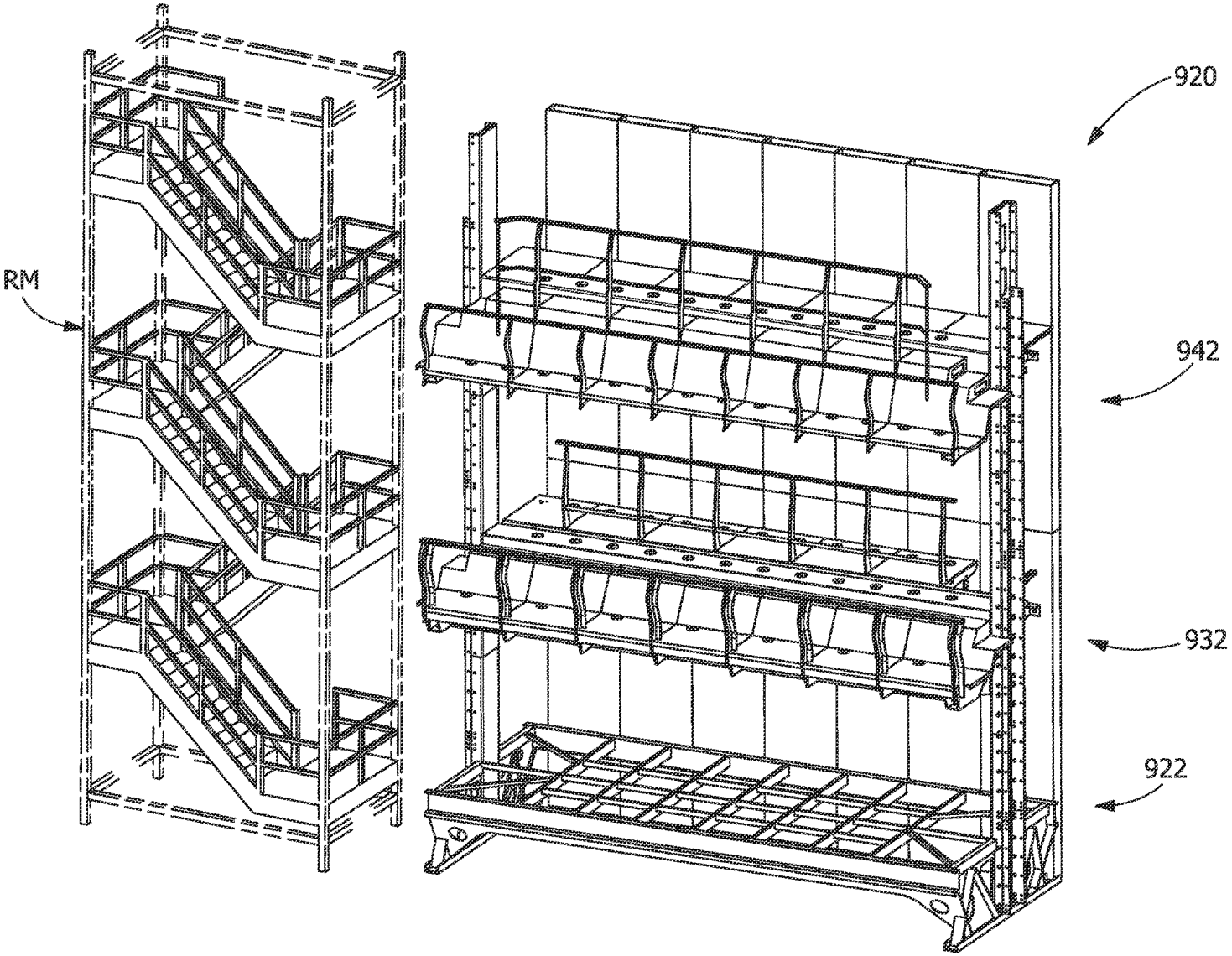
FIG. 44 is an exemplary audience host combination.

Reference is now had to FIG. 44, which collectively illustrate an exemplary product manufactured in accordance with the method of the present invention and this product has been designed, manufactured (including via the inclusion of pre-fabricated sub-assemblies), and transported to and disposed in an end disposition at a permanent site, in accordance with the present invention. The exemplary product, when disposed in its end disposition at a permanent site, is shown solely for illustration purposes as providing a multi-tier audience accommodation portion of a theater and the exemplary product is hereinafter referred to as the audience host combination 920.

The audience host combination 920 includes a sill portion 922 that is configured to support thereon a plurality of tiers and each of these tiers is configured as a patron platform capable of handling multiple persons in transit thereacross [e.g., aisle or other passageway] and/or multiple persons as each is located at a viewing location thereon [e.g., seats, wheelchair parking locations, standing patron locations].

The audience host combination 920 includes a first patron platform 932 and a second patron platform 942 and each of the patron platform 932 and the second patron platform 942 are capable of handling multiple persons in transit thereacross [e.g., aisle or other passageway] and/or multiple persons as each is located at a viewing location thereon [e.g., seats, wheelchair parking locations, standing patron locations]. The first patron platform 932 and the second patron platform 942 are supported in the audience host combination 920 relative to one another such that the sight lines of patrons in viewing locations of the first patron platform 932 are not obstructed by the second patron platform 942.

Each of the first patron platform 932 and the second patron platform 942 comprises one or more pre-fabricated combinations and each pre-fabricated combination: (a) forms a viewing location thereon [e.g., a location at which a seat will be located, a wheelchair parking location, a standing patron location] and (b) comprises an organic load bearing feature.

Each pre-fabricated combination has been pre-fabricated to the extent that it is a ready-to-be-deployed unit that can be lifted, lowered, or otherwise manipulated as a single integral piece into its final position on the audience host combination 920 and the organic load bearing feature of each pre-fabricated combination can be mated with, and/or connected to, the organic load bearing structure of another pre-fabricated combination and/or mated with, or connected to, a support component, such that the pre-fabricated combination can maintain itself as a self-supporting entity after it has been disposed into its final position on the audience host combination 920. The audience host combination 920 can be configured identical to the audience host combination 10 described with respect to FIGS. 1-41.

As seen in FIG. 44 in broken lines, a stair tower module RM may be operatively associated with the audience host combination 920 via, for example, multiple connection locations interconnecting the stair tower module RM to a respective one of the vertical columns of the audience host combination 920. The stair tower module RM may provide an access pathway between the several patron platforms of the audience host combination 920 and, optionally, may provide additional structural support for the audience host combination 920 in its final position at the permanent site. The stair tower module RM includes a plurality of stairs, a plurality of handrails, and a plurality of intermediate landings each positioned between a respective pair of stairs and selected ones of which are operatively associated with the patron platforms of the audience host combination 920 so that patrons can transit to and between the patron platforms via the stair tower module RM.

Figure 43:
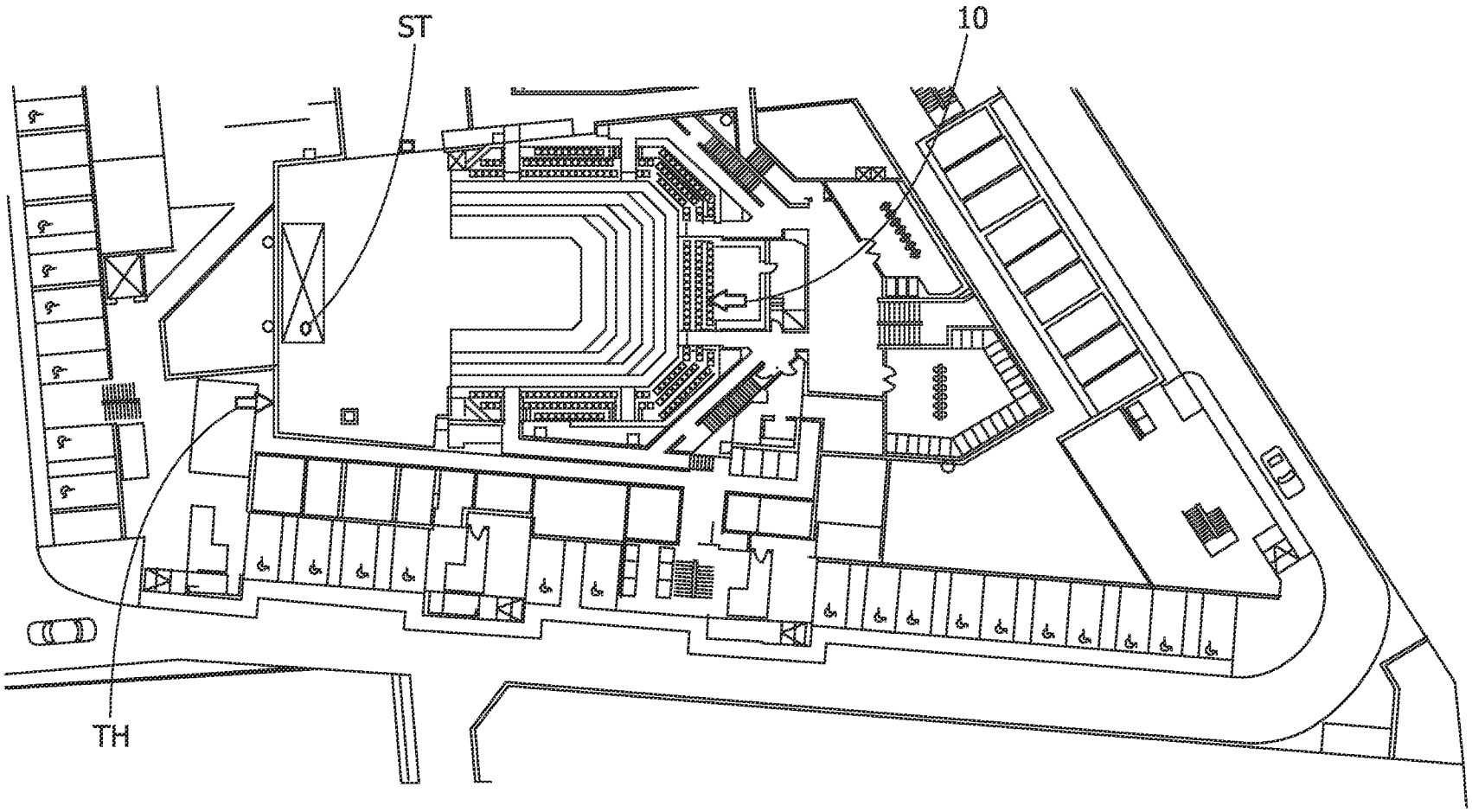
FIG. 43 is a schematic top plan view of an exemplary theater.
Figure 45:
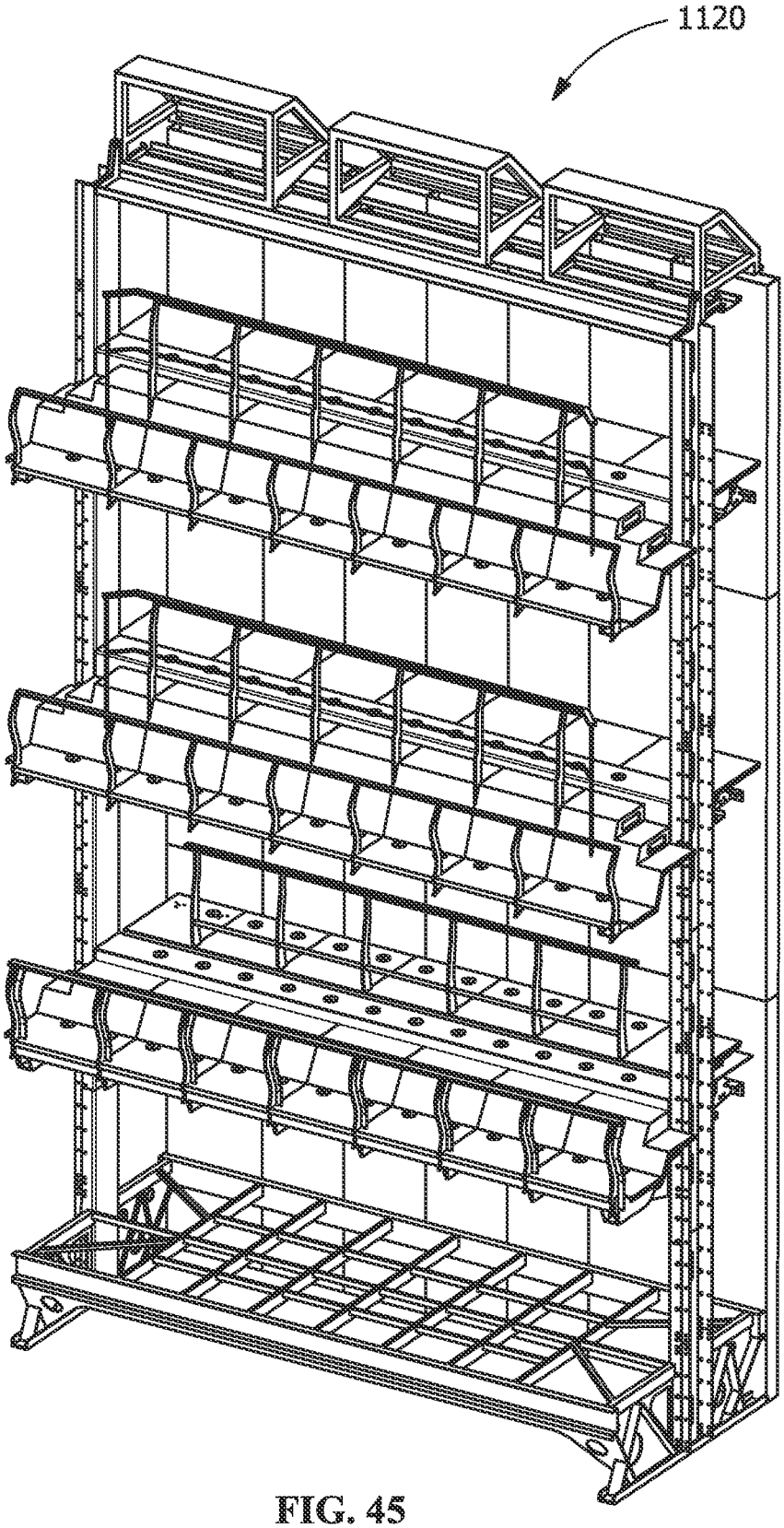
FIG. 45 is an exemplary modular auditorium.

Reference is now had to FIG. 43 and FIG. 45, which collectively illustrate one variation of the exemplary audience host combination shown in FIG. 44. As seen in FIG. 43, which is a schematic top plan view of a theater having a stage and having a variation of the audience host combination of the present invention, the exemplary audience host combination is configured as a modular auditorium 1120 particularly configured for deployment in a theater TH having a stage or performance presentation area, exemplarily shown as a stage ST. The modular auditorium is configured to accommodate patrons at viewing areas from which the patrons can watch a performance on the stage ST of the theater TH. The modular auditorium 1120 includes the core elements of multiple stories of patron platforms supported on vertical columns which themselves are cross-connected and stabilized by a base platform. Additionally, the modular auditorium 1120 engenders a pre-fabricated nature.

With regard to further details of the patron platforms of the modular auditorium 1120, there is provided a group of four patron platforms, each patron platform being capable of handling multiple persons in transit thereacross [e.g., aisle or other passageway] and/or multiple persons as each is located at a viewing location thereon [e.g., seats, wheelchair parking locations, standing patron locations], and each patron platform having a forward region having multiple viewing locations and a backset region having multiple viewing locations, the forward region and the backset region being in front-to-back staggered relationship to each other and the sight lines of patrons in viewing locations of the backset region are not obstructed by the forward region.

With regard to further details of the vertical columns of the modular auditorium 1120, there is provided a pair of vertical columns.

With regard to further details of the base platform of the modular auditorium 1120, each vertical column has its lower end secured to the base platform and the base platform provides structural stability to support the vertical columns in their vertical orientations. The patron platforms are secured to the pair of vertical columns with each patron platform extending to and between the pair of vertical columns and the patron platforms being serially disposed one above another to consequently provide a gallery for patrons comprised of patron platforms each at a respective first story, second story, etc.

Each of the four patron platforms comprises one or more pre-fabricated combinations with each pre-fabricated combination: (a) forming a viewing location thereon [e.g., a location at which a seat will be located, a wheelchair parking location, a standing patron location] and comprising an organic load bearing feature. Each pre-fabricated combination has been pre-fabricated to the extent that it is a ready-to-be-deployed unit that can be lifted, lowered, or otherwise manipulated as a single integral piece into its final position and the organic load bearing feature of each pre-fabricated combination can be mated with, and/or connected to, the organic load bearing structure of another pre-fabricated combination and/or mated with, or connected to, one of the vertical columns, such that the pre-fabricated combination can maintain itself as a self-supporting entity after it has been disposed into its final position.

Figure 42:
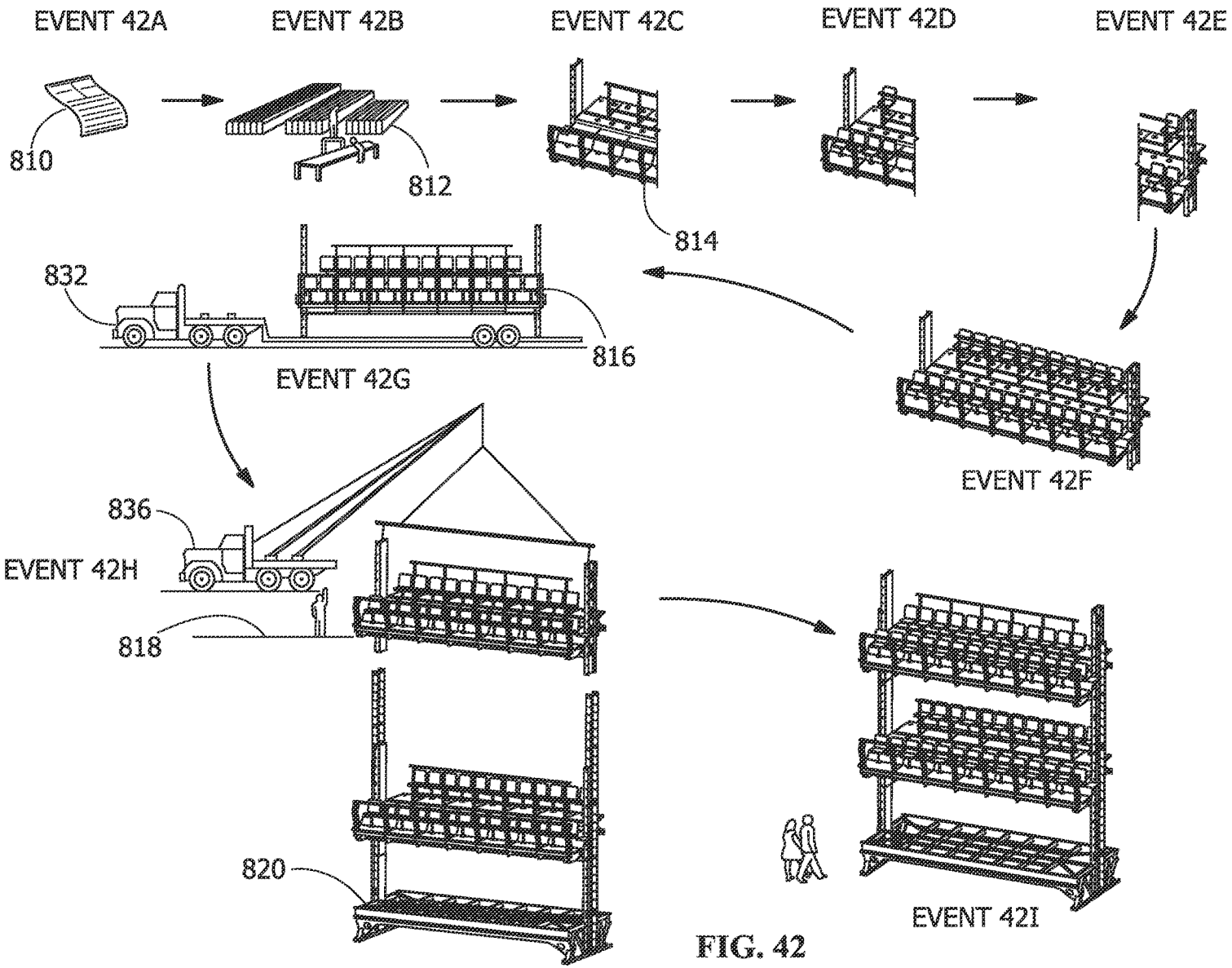
FIG. 42 is a schematic of an exemplary configuration cycle including events 42(A)-42(I), for configuring a performance space of an exemplary audience host combination.

Reference is now had to FIG. 42, which is a schematic overview of an exemplary configuration cycle for configuring a performance space with an audience host combination of the present invention. As seen in FIG. 42, an exemplary configuration cycle for configuring a performance space with a modular auditorium of the present invention includes an exemplary process for manufacturing a unit of the modular auditorium, an exemplary method for transporting the thus-manufactured components of the unit of the modular auditorium to a permanent site, and an exemplary on-site method for disposing the unit of the modular auditorium into its end disposition at the permanent site. The exemplary configuration cycle will be described with respect to a series of events schematically shown in FIG. 42 as EVENTS 42(C)-42(I). The exemplary element of the modular auditorium that is described in connection with the exemplary configuration cycle is a unit of the modular auditorium 10 that has been described with respect to FIGS. 1-44.

The exemplary process for manufacturing a unit of the modular auditorium includes an on-site instantiation phase and an off-site phase during which some or all of the unit of the modular auditorium is assembled together prior to instantiation of the unit of the modular auditorium at its permanent site. The off-site phase may be initiated in response to the receipt of an order placed by a customer for a unit of the modular auditorium, as illustrated as EVENT 42(A) in FIG. 42. Each unit of the modular auditorium manufactured in accordance with the exemplary process for manufacturing a unit of the modular auditorium is comprised of a plurality of elements ultimately disposed and/or interconnected to one another and at least one of these elements is created via the application of pre-fabrication production techniques and is denominated as a ship and drop package comprised of a plurality of components assembled with one another.

A work order 810 is produced and given to off-site assembly workers at a component production area 812, as illustrated in EVENT 42(B). At the component production area 812, off-site assembly workers create a stockage of pre-made component parts by measuring, cutting, and drilling raw material from inventory using various jigs. Once measured, cut, and drilled, the pre-made component parts needed to build a ship and drop package for a particular unit of the audience host combination are delivered to a component in-process assembly area 814 (EVENTS 42(C)-42(E)).

The pre-made components are supplied to the off-site assembly workers at the component in-process assembly area 814, whereupon, as a result of several of the components having already been pre-made in the component production area 812, the off-site assembly workers need not measure, drill or cut each and every component part for use in building the ship and drop package. Instead, assembly only involves the assembly of components into a ship and drop package 816 using jigs that are specially made for each ship and drop package 816.

All ship and drop packages are completed via various steps, of which several are exemplarily illustrated in EVENTS 42(D)-42(E). Thus, all ship and drop packages 816 are finished at the factory and are ready to attach to an appropriate foundation or other structure, including other ship and drop packages 816, at the permanent site at which the unit of the modular auditorium is to be instantiated—here shown as a building site 818.

At the building site 818, a base pad 820 is prepared. In connection with the method for transporting the thus-manufactured components of the unit of the audience host combination to a permanent site, the ship and drop package 816 and other ship and drop packages are attached to towed trailers 832 for transport from the factory to the building site 818. Loads are appropriate in mass and/or are dimensioned to comply with applicable road transport, rail transport, or waterway transport requirements.

In connection with the exemplary on-site erection sequence for disposing the thus-manufactured ship and drop packages of the unit of the audience host combination into its end disposition at the permanent site, as trailer loads arrive at the building site 818 (EVENT 42(G)), a crane 836 places the ship and drop packages on the prepared base pad 820, as illustrated in EVENT 42(H). When the structure is completed, as illustrated in EVENT 42(I), then the performance space now incorporating the unit of the modular auditorium can be operated to provide performances or further configuration of the performance space can proceed in parallel or in series with the instantiation of the unit of the modular auditorium at the building site 818.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for assembling a theater comprising:

providing a surface for supporting the weight of a modular auditorium within a building structure;

assembling the modular auditorium by providing a plurality of nominal inventory portions, each nominal inventory portions comprising:

a prefabricated base portion; and a prefabricated tier section for assembly to the base portion;

positioning the prefabricated base portion on the surface; and fastening the prefabricated tier section to the base portion to form a self supporting modular auditorium structure that does not require lateral support from the building structure other than the ground surface;

wherein the prefabricated tier section includes a tier floor having a first floor portion and a second floor portion cantilevered from opposed regions of a longitudinal beam.

2. The method of claim 1, further comprising providing a stage or performance presentation area to the surface.

3. The method of claim 1, further comprising configuring the modular auditorium to accommodate patrons at viewing areas from which the patrons are able to watch a performance on the stage or performance presentation area.

4. The method of claim 1, wherein the surface is a prepared ground surface.

5. The method of claim 1, wherein the surface is a man-made surface.

6. The method of claim 1, wherein the first floor portion, and the second floor portion include an interface for accommodating a chair and for lifting the at least one tier section.

7. The method of claim 1, wherein the first floor portion and the second floor portion are non-movable relative to the base portion.

8. The method of claim 1, wherein the prefabricated base portion includes a base portion vertical beam and the prefabricated tier section includes a tier section vertical beam.

9. The method of claim 8, wherein the fastening includes fastening the base portion vertical beam to the tier section vertical beam.

10. The method of claim 9, wherein flange extensions secure the base portion vertical beam to the tier section vertical beam end-to-end without welding.

11. A theater comprising:

a modular auditorium disposed on a surface for supporting the weight of a modular auditorium within a building structure, the modular auditorium comprising:

a plurality of nominal inventory portions, each nominal inventory portions comprising:

a prefabricated base portion; and a prefabricated tier section for assembly to the prefabricated base portion;

wherein the modular auditorium, when assembled, is self supporting and does not require lateral support from a building structure other than the surface;

wherein the prefabricated tier section includes a tier floor having a first floor portion and a second floor portion cantilevered from opposed regions of a longitudinal beam.

12. The theater of claim 11, further comprising a stage or performance presentation area on the surface.

13. The theater of claim 11, wherein the modular auditorium is configured to accommodate patrons at viewing areas from which the patrons are able to watch a performance on the stage or performance presentation area.

14. The theater of claim 11, wherein the surface is a prepared ground surface.

15. The theater of claim 11, wherein the surface is a man-made surface.

16. The theater of claim 11, wherein the first floor portion, and the second floor portion include an interface for accommodating a chair and for lifting the at least one tier section.

17. The theater of claim 11, wherein the first floor portion and the second floor portion are non-movable relative to the base portion.

18. The theater of claim 11, wherein the prefabricated base portion includes a base portion vertical beam and the prefabricated tier section includes a tier section vertical beam.

19. The theater of claim 11, further comprising flange extensions arranged and disposed to secure the base portion vertical beam to the tier section vertical beam end-to-end without welding.

20. The theater of claim 11, further comprising a back wall constructed with passageways for providing electrical wiring, conveying ventilation air and providing egress/ingress for spectators to each prefabricated tier section.

21. The theater of claim 11, wherein each nominal inventory portion is configured to be transportable and positioned for assembly with other nominal inventory portions by a forklift machine.

22. The theater of claim 11, wherein prefabricated tier section includes seats and handrails.

* * * * *